US005761921A

United States Patent [19]

Hori et al.

[11] Patent Number: 5,761,921

[45] Date of Patent: Jun. 9, 1998

[54] AIR CONDITIONING EQUIPMENT

[75] Inventors: Masato Hori; Motonori Futamura; Hiroichi Yamaguchi; Kazuo Saito, all of Tokyo, Japan

[73] Assignee: Kabushiki Kaisha Toshiba, Kawasaki, Japan

[21] Appl. No.: 816,431

[22] Filed: Mar. 14, 1997

[30] Foreign Application Priority Data

Mar. 14, 1996 [JP] Japan ..... 8-057687
Jan. 31, 1997 [JP] Japan ..... 9-019233

[51] Int. Cl.[6] ..... F25B 27/00

[52] U.S. Cl. ..... 62/238.4; 62/501; 62/324.1; 62/335; 417/902

[58] Field of Search ..... 62/238.4, 500, 62/501, 335, 506, 324.1, 498, 468; 417/902

[56] References Cited

U.S. PATENT DOCUMENTS 4,464,908 8/1984 Landerman et al. ..... 62/238.4
5,136,854 8/1992 Abdelmalek ..... 62/501

FOREIGN PATENT DOCUMENTS 57-153712 3/1981 Japan .

*Primary Examiner*—John M. Sollecito
*Attorney, Agent, or Firm*—Foley & Lardner

[57] ABSTRACT

An air conditioning equipment is provided wherein reduction in size of an outdoor heat exchanger, improvement of reliability, and low cost can be achieved without reduction in system efficiency. In the air conditioning equipment, the same working medium is employed in Rankine cycle (first cycle) and refrigerant cycle (second cycle) and an expander and a compressor used in respective cycles are installed in the same enclosure.

21 Claims, 23 Drawing Sheets

BINARY CYCLE

UNITARY CYCLE

AIR CONDITIONING EQUIPMENT

BACKGROUND OF THE INVENTION

1. Field of the Invention

The present invention relates to an air conditioning equipment in which a compressor is driven by rotating power generated by an expander, that is, a compressor in a refrigerating cycle is driven in terms of a Rankine cycle.

2. Description of the Prior Art

As a system for conditioning an air by using a gas (vapor) (air conditioning equipment), there has been a system in which a compressor incorporated in the refrigerating cycle is driven in terms of the Rankine cycle consisting of a pump, a refrigerant heater, an expander, an outdoor heat exchanger, etc. An example of this system has been disclosed in Patent Application Publication (KOKAI) 57-153712.

As the air conditioning equipment of this kind, there have existed a binary system of an air conditioning equipment wherein two type of media are employed as working medium (see FIG. 1A) and a unitary system of an air conditioning equipment wherein the same working medium is employed on both the Rankine cycle side and the refrigerating cycle side and further an outdoor heat exchanger (condenser) is commonly employed on both the Rankine cycle side and the refrigerating cycle side (see FIGS. 1B and 2 (Patent Application Publication (KOKAI) 57-26365)).

In the above binary system, different working media are employed in the Rankine cycle and the refrigerating cycle. Therefore, unless a special coupling such as magnet coupling is used, it is hard to seal the expander and the compressor completely from a viewpoint of preventing mixture of both working media and leakage of the working media to the outdoor air. Furthermore, a special medium (e.g., R236ea) has often been employed as the working medium on the Rankine cycle side.

There has been such problems that above special medium such as magnet coupling has brought about not only increase in size of both the expander and the compressor and increase in cost but also reduction in efficiency and that expensive oil, refrigerant, or the like has to be employed.

In order to overcome such problems, the unitary system has been thought out in which an outdoor heat exchanger is employed commonly to enable simplification and tight sealing of the equipment.

As shown in FIG. 2, the unitary system of the air conditioning equipment disclosed in Patent Application Publication (KOKAI) 57-26365 will be explained in brief hereinbelow.

A reference 113 denotes an outer heat exchanger which can operate as a condenser in the Rankine cycle and heat pump cycle (refrigerating cycle) in cooling mode and also operate as an evaporator in the heat pump cycle in heating mode. A reference 114 is an indoor heat exchanger which can operate the evaporator in heat pump cycle to cool an indoor air in cooling mode and can also operate as the condenser in the Rankine cycle and the heat pump cycle to heat the indoor air in heating mode.

A reference 115 is a working fluid liquid pump; 116, a generator; and 117, an expander. All constitute the Rankine cycle if being connected appropriately.

A reference 118 is a compressor which is driven by the expander 117. A discharge side of the compressor 118 is connected to an outlet side of the expander 117, and then connected to a four-way valve 119 which can switch flow of working fluid in cooling mode as indicated by solid lines in FIG. 2 and in heating mode as indicated by broken lines in FIG. 2. A heat pump cycle consists of the compressor 118, the four-way valve 119, the indoor heat exchanger 114, the outdoor heat exchanger 113, and a throttling mechanism 120.

References 121, 122 are check valves which can control flow of refrigerant corresponding to heating and cooling modes; 123, a heating source (burner) for heating the generator 116; 124, a fan for cooling the outdoor heat exchanger 113; and 125, a fan for cooling the indoor heat exchanger 114.

However, in the middle of developing the above unitary system of the air conditioning equipment, the inventors of the present invention have found following disadvantages of the unitary system in the prior art.

First, the outdoor heat exchanger can be made smaller as a difference between the outdoor air temperature and the condensing temperature (condensing pressure) becomes larger. However, since power required for the compressor is increased much more as the difference between the outdoor air temperature and the condensing temperature becomes larger, it is difficult to reduce size of the outdoor heat exchanger.

In addition, since the Rankine cycle interferes with the refrigerating cycle due to mixture of the working media in the outdoor heat exchangers, decrease in efficiency in the Rankine cycle also causes decrease in efficiency in the refrigerating cycle in addition to the Rankine cycle. As a result, efficiency of the equipment is extremely gone down.

Further, in order to operate the pump which is incorporated into the Rankine cycle, the refrigerant which has already been undercooled to some extent must be sucked into the pump since the working medium is in general made of a refrigerant such as R22 having small viscosity. Undercooling degree of the refrigerant can be increased with the increase in difference between the outer air temperature and the condensing temperature. However, since the higher condensing temperature renders the power required for operating the compressor higher, the pump is caused to be operated defectively. It would be understood that such undercooling degree cannot be so increased.

Furthermore, there has been detected a following problem from another viewpoint. In other words, in starting operation, a high pressure gas must be fed to the expander which generates rotating power by means of high pressure gas, and therefore means for cutting off an inlet side of the expander temporarily is provided, for instance. In this method, a gas pressure is ready to become unstable. Thus, because an inlet pressure of the expander is controlled under an unstable condition, such a disadvantage has arisen that a stable starting of the expander cannot be expected. Further, in order to improve the starting performance, a means for reducing the load in starting the expander, etc. are provided by connecting the discharge side and the suction side of the compressor acting as the load of the expander.

SUMMARY OF THE INVENTION

Therefore, the present invention has been made in the light of the above circumstances and it is an object of the present invention to provide an air conditioning equipment capable of achieving reduction in size of outdoor heat exchangers, improvement in reliability, and low cost without decrease in system efficiency.

It is another object of the present invention to provide an air conditioning equipment capable of achieving stable control of an inlet pressure of an expander in starting operation.

It is still another object of the present invention to provide an air conditioning equipment capable of achieving reduction in size of outdoor heat exchangers and prevention of defective operation of a pump, and improving a coefficient of performance (COP) of the equipment.

It is still another object of the present invention to provide an air conditioning equipment capable of achieving reduction in size of the equipment, improvement in the COP, and recovery of exhaust heat.

It is still another object of the present invention to provide an air conditioning equipment capable of carrying out cooling and hot-water supply.

It is still another object of the present invention to provide an air conditioning equipment capable of improving reliability of the equipment.

It is still another object of the present invention to provide an air conditioning equipment capable of bringing about improvement of efficiency and comfortableness.

It is still another object of the present invention to provide an air conditioning equipment capable of improving efficiency of the equipment.

It is still another object of the present invention to provide an air conditioning equipment capable of bringing about improvement of defrosting performance.

It is still another object of the present invention to provide an air conditioning equipment capable of bringing about good reliability and comfortableness.

It is still another object of the present invention to provide an air conditioning equipment capable of achieving stable control of an inlet pressure of an expander in terms of a closed cycle through which the refrigerant is circulated, and achieving smooth and firm starting of the expander in a starting operation, and improving starting performance and reliability of the equipment.

It is still another object of the present invention to provide an air conditioning equipment capable of accelerating gasification of the refrigerant by supplying its heat to an expander and a compressor, and thus preventing standstill of the refrigerant to thus reduce a load and facilitate the starting operation.

It is still another object of the present invention to provide an air conditioning equipment capable of simplifying a circuit configuration of a closed cycle, and preventing the standstill refrigerant from being fed into an expander or compressor side.

In order to achieve the above objects, there is provided an air conditioning equipment comprising: a refrigerant heater for heating a refrigerant; an expander for expanding said refrigerant output from said refrigerant heater to generate a driving force; an outdoor heat exchanger for cooling said refrigerant output from said expander; a pump for feeding said refrigerant output from said outdoor heat exchanger to said refrigerant heater, whereby said refrigerant heater, said expander, said outdoor heat exchanger, and said pump constitute a first cycle; a compressor operated by said driving force derived from said expander in cooling operation mode, for compressing a refrigerant; an outdoor heat exchanger for cooling said refrigerant discharged from said compressor; an expansion valve for expanding said refrigerant output from said outdoor heat exchanger; and an indoor heat exchanger for receiving said refrigerant whose temperature is lowered by said expansion valve, whereby said compressor, said outdoor heat exchanger, said expansion valve, and said indoor heat exchanger constitute a second cycle; wherein said refrigerant circulated in said first cycle and said refrigerant circulated in said second cycle are identical in composition, and said compressor and said expander are incorporated into a same sealing case.

In the preferred embodiment of the present invention, a condensing pressure of said first cycle and a condensing pressure of said second cycle in cooling mode are set to different values in Mollier chart.

In the preferred embodiment of the present invention, a radiating source in a condensing operation in said second cycle and a radiating source in a condensing operation of said first cycle are made as different radiating sources.

In the preferred embodiment of the present invention, the air conditioning equipment further comprises means for enabling working medium to transfer between said first cycle and said second cycle.

In the preferred embodiment of the present invention, the air conditioning equipment further comprises means for enabling oil to transfer between said first cycle and said second cycle.

In the preferred embodiment of the present invention, a refrigerant gas fed from said refrigerant heater constituting said first cycle is introduced into said indoor heat exchanger constituting said second cycle in heating mode.

In the preferred embodiment of the present invention, a refrigerant gas fed from said compressor constituting said second cycle is introduced into said indoor heat exchanger constituting said second cycle in heating mode.

In the preferred embodiment of the present invention, a mixed gas of a gas discharged from said compressor constituting said second cycle and a gas discharged from said expander constituting said first cycle is introduced into said indoor heat exchanger constituting said second cycle in heating mode.

In the preferred embodiment of the present invention, said outdoor heat exchanger for cooling said refrigerant fed from said expander and said outdoor heat exchanger for cooling said refrigerant discharged from said compressor are installed in a same enclosure such that poor heat transfer is assured between them.

In the preferred embodiment of the present invention, said outdoor heat exchanger for cooling said refrigerant fed from said expander and said outdoor heat exchanger for cooling said refrigerant discharged from said compressor are installed in a same enclosure such that good heat transfer is assured between at least part of them.

In the preferred embodiment of the present invention, said outdoor heat exchanger for cooling said refrigerant fed from said expander and said outdoor heat exchanger for cooling said refrigerant discharged from said compressor are equipped with independent outdoor fans respectively.

In the preferred embodiment of the present invention, said outdoor heat exchanger for cooling said refrigerant fed from said expander also serves as said outdoor heat exchanger for cooling said refrigerant discharged from said compressor.

In the preferred embodiment of the present invention, said refrigerant fed from said outdoor heat exchanger is introduced into said pump via a receiver.

In the preferred embodiment of the present invention, the air conditioning equipment further comprises a flow path for connecting said refrigerant heater to said receiver, and a switching valve for isolating selectively said refrigerant heater from said expander, and wherein, when said switching valve is closed, said refrigerant fed from said refrigerant heater is circulated through a closed cycle consisting of said refrigerant heater, said receiver, said pump, and said flow path.

In the preferred embodiment of the present invention, the air conditioning equipment further comprises, in heating mode, a third cycle in which said first refrigerant discharged from said pump is fed directly to said indoor heat exchanger via said refrigerant heater and then returned from said receiver to said pump once again.

In the preferred embodiment of the present invention, said closed cycle is constituted such that a circulation of said refrigerant is branched off from a circuit extending from said refrigerant heater to an inlet side of said expander, then passed through a throttle valve, said receiver and said pump, and then returned to said refrigerant heater again.

In the preferred embodiment of the present invention, a condenser is provided between said throttle valve and said receiver constituting said closed cycle.

In the preferred embodiment of the present invention, when said refrigerant is circulated in said closed cycle, a circulation of said refrigerant is branched off from a circuit extending from said refrigerant heater to an inlet side of said expander, and then passed through a heating circuit for heating said expander and said compressor, a throttle valve, said receiver and said pump, and then returned to said refrigerant heater again.

In the preferred embodiment of the present invention, an operation of said pump constituting said closed cycle is continued even when an operation of said expander is halted.

In the preferred embodiment of the present invention, when said refrigerant is circulated in said closed cycle, a circulation of said refrigerant is branched off from a circuit extending from said refrigerant heater to an inlet side of said expander, and then passed through a throttle valve, said outdoor heat exchanger, said receiver and said pump, and then returned to said refrigerant heater again.

In the preferred embodiment of the present invention, a check valve for preventing a flow of a working gas from a throttle valve to an outlet side of said expander is provided in a circuit including said throttle valve constituting said closed cycle.

DETAILED DESCRIPTION OF THE EMBODIMENTS

Embodiments of the present invention will be explained with reference to accompanying drawings hereinafter.

Refrigerants used in respective following embodiments are denoted by the same reference symbol in first and second cycles. R134*a*, etc. are suitable for the refrigerants used in respective following embodiments.

First Embodiment

Figure 1A:
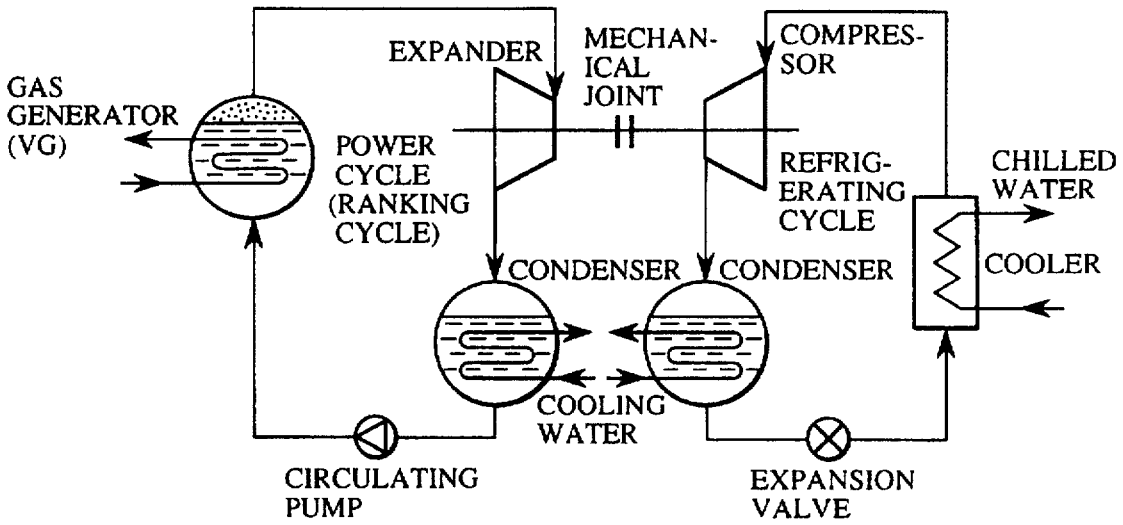
FIG. 1A PRIOR ART
FIG. 1A is a schematic view showing a binary system of an air conditioning equipment in the prior art.
Figure 1B:
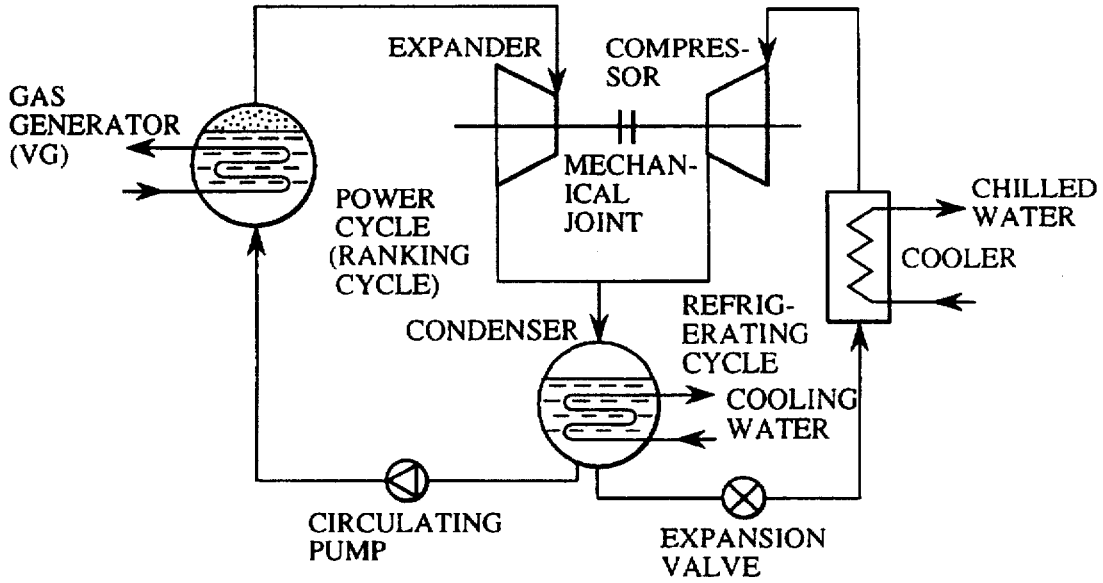
FIG. 1B PRIOR ART
FIG. 1B is a schematic view showing a unitary system of an air conditioning equipment in the prior art.
Figure 2:
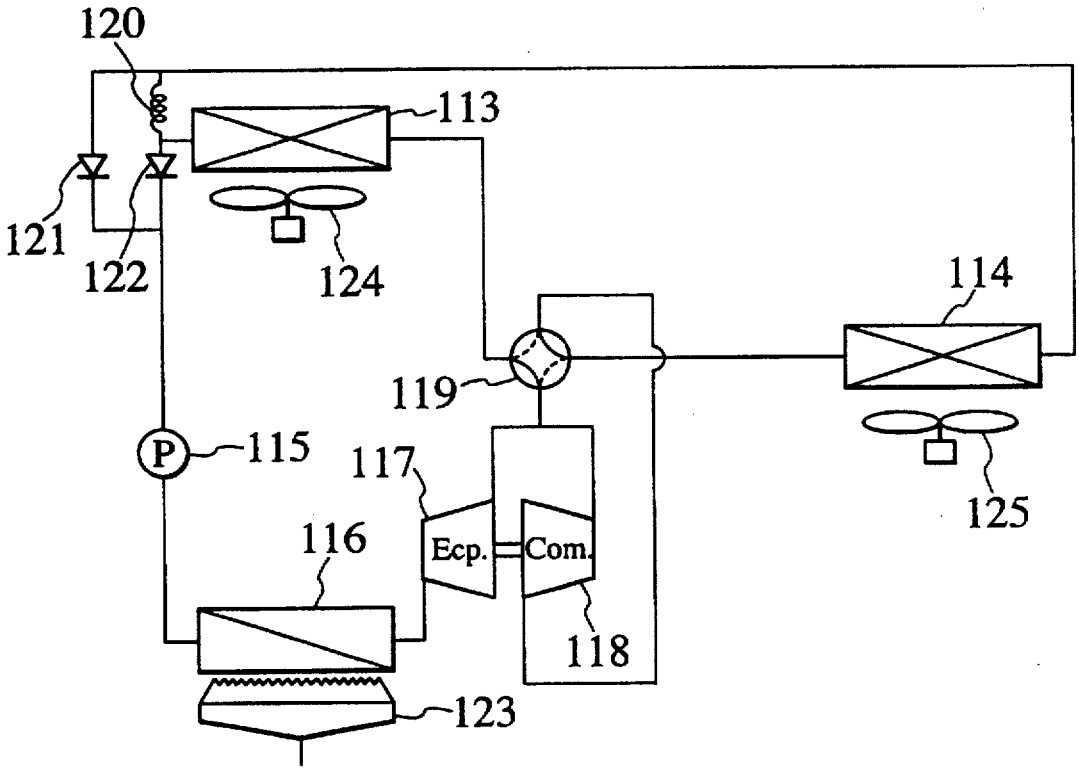
FIG. 2 PRIOR ART
FIG. 2 is a block diagram showing an air conditioning equipment in the prior art.
Figure 3:
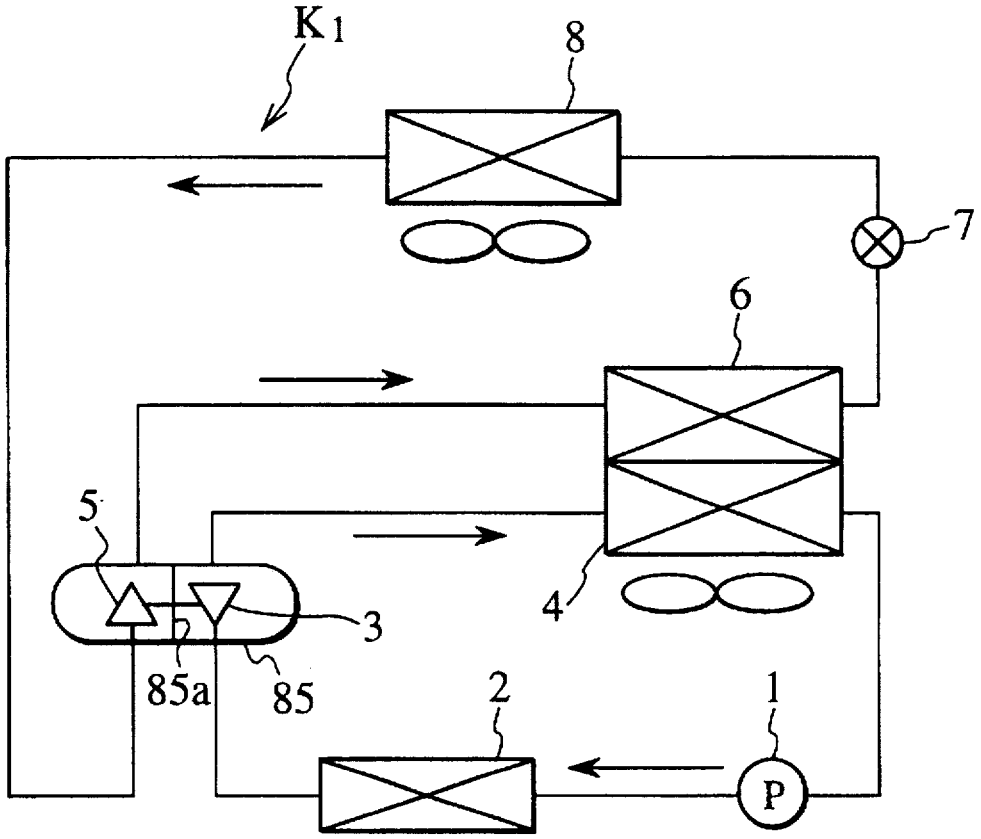
FIG. 3 is a block diagram showing an air conditioning equipment according to a first embodiment of the present invention.

FIG. 3 is a block diagram showing an air conditioning equipment K1 according to a first embodiment of the present invention.

As shown in FIG. 3, the air conditioning equipment K1 consists of a first cycle (Rankine cycle) which is composed of a pump 1, a refrigerant heater 2, an expander 3, an outdoor heat exchanger (first outdoor heat exchanger) 4, etc., and a second cycle (refrigerating cycle) which is composed of a compressor 5, an outdoor heat exchanger (second outdoor heat exchanger) 6, an expansion valve 7, an indoor heat exchanger 8, etc.

The outdoor heat exchanger 4 and the outdoor heat exchanger 6 are integrally formed, but their pipings are provided independently not to mix refrigerants in the first and second cycles mutually.

The compressor 5 and the expander 3 are incorporated in a same sealing case 85. The compressor 5 and the expander 3 are isolated by a pressure bulkhead 85*a* in the sealing case 85. This is because a pressure of the first cycle must be isolated from a pressure of the second cycle. Mutual axes of the compressor 5 and the expander 3 are connected to make the expander 3 drive the compressor 5. In addition, cheap mechanical seal is used as bearing seal between the compressor 5 and the expander 3.

If, because of a long time operation of the air conditioning equipment K1, a very small amount of transfer of the refrigerant or the oil occurs via the bearing seal between the compressor 5 and the expander 3, no problem arises since the same refrigerant is used in the first and second cycles. Further, because the same sealing case is employed, an overall configuration of the equipment can be made compact, and cost reduction can be enabled, and further reliability of mechanical coupling between the compressor 5 and the expander 3 can also be improved With the above configuration, in the first cycle, the refrigerant fed from the pump 1 to the refrigerant heater 2 is evaporated into gas refrigerant and then flows into the expander 3. Then the gas refrigerant is expanded in the expander 3 to generate work, and thus drives the compressor 5. The refrigerant flown out from the expander 3 is condensed in the outdoor heat exchanger 4 and then sucked into the pump 1.

Meanwhile, in the second cycle, the gas refrigerant discharged from the compressor 5 is condensed in the outdoor heat exchanger 6, then converted into refrigerant with low temperature and low pressure by the expansion valve 7, then evaporated by the indoor heat exchanger 8, and then sucked into the compressor 5 once again. If the air conditioning equipment K1 is operated for a long time while repeating the above operations, a very small amount of the refrigerant or the oil is transferred via the bearing seal between the compressor 5 and the expander 3. But no problem is caused because the refrigerants having the same composition are employed in the compressor 5 and the expander 3.

Figure 4A:
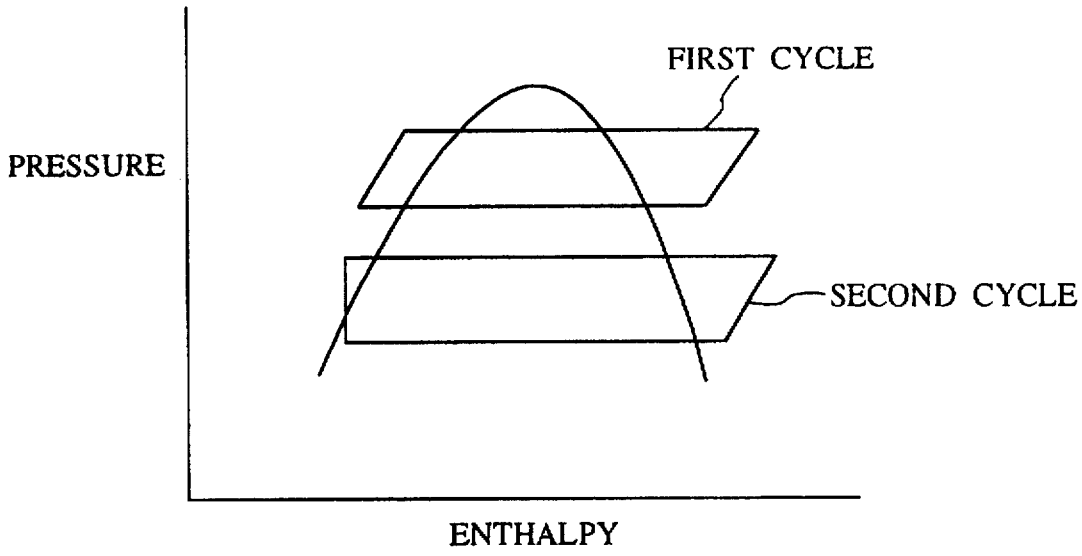
FIG. 4A is a Mollier chart of the air conditioning equipment according to the first embodiment of the present invention.

FIG. 4A is a Mollier chart of the air conditioning equipment K1 in operation mode. A condensing temperature in the first cycle (Rankine cycle) is set higher than a condensing temperature in the second cycle (refrigerating cycle). That is, even though the same refrigerant is employed, the pipings of the first and second cycles are provided independently and as a result the condensing temperature in the first cycle and the condensing temperature in the second cycle can be set independently.

Figure 4B:
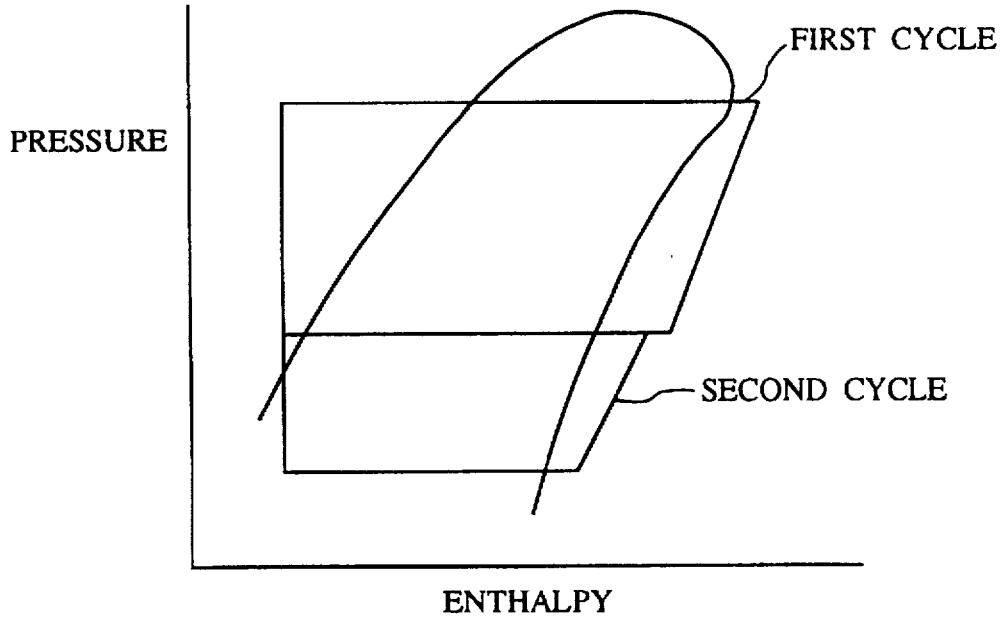
FIG. 4B is a Mollier chart of the air conditioning equipment in the prior art.

FIG. 4B is a Mollier chart of the air conditioning equipment disclosed in Patent Application Publication (KOKAI) 57-26365 in the prior art.

Second Embodiment

Figure 5A:
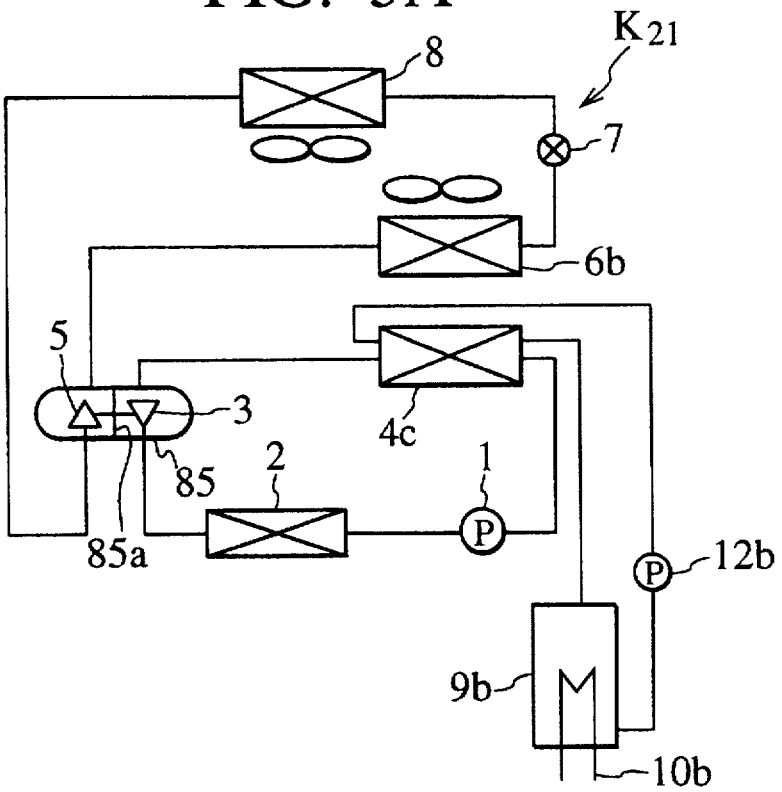
FIG. 5A is a block diagram showing an air conditioning equipment according to a second embodiment of the present invention.
Figure 5B:
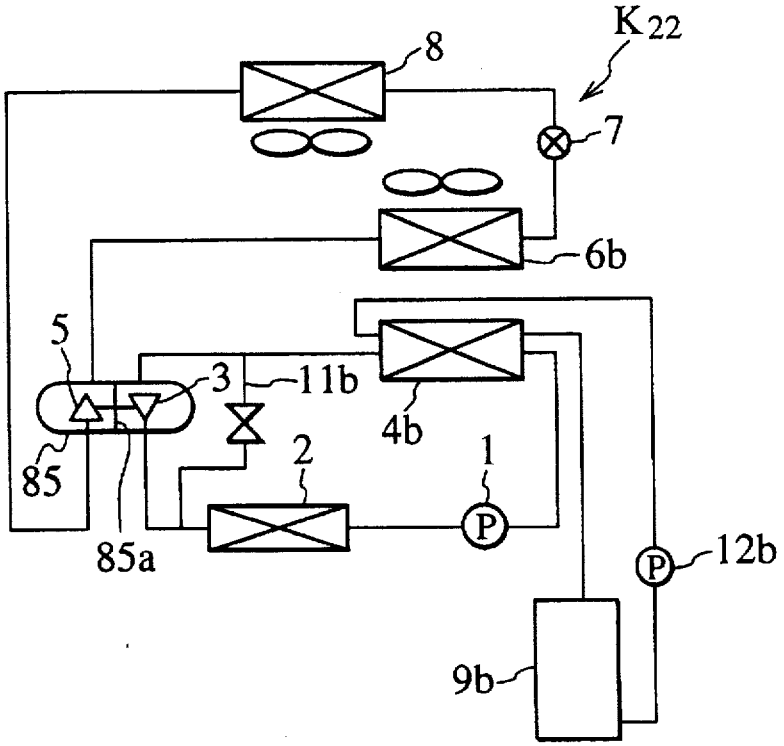
FIG. 5B is a block diagram showing an air conditioning equipment according to a modification of the second embodiment of the present invention.

FIG. 5A is a block diagram showing an air conditioning equipment K21 according to a second embodiment of the present invention. FIG. 5B is a block diagram showing an air conditioning equipment K22 according to a modification of the second embodiment of the present invention.

As shown in FIG. 5A, the air conditioning equipment K21 consists of a first cycle (Rankine cycle) which is composed of the pump 1, the refrigerant heater 2, the expander 3, an outdoor heat exchanger 4*b* described hereinbelow, etc., and a second cycle (refrigerating cycle) which is composed of the compressor 5, an outdoor heat exchanger 6*b* described hereinbelow, the expansion valve 7, the indoor heat exchanger 8, etc.

The outdoor heat exchanger 4*b* is formed of a water cooled heat exchanger such as double pipe type or plate type heat exchanger. The outdoor heat exchanger 6*b* is formed of an air cooled heat exchanger such as fin tube type heat exchanger.

The water cooled outdoor heat exchanger 4*b* is connected to a hot water storage tank 9*b* via a pump 12*b* so as to accumulate exhaust heat generated in the first cycle. Further, axes of the compressor 5 and the expander 3 are connected using mechanical seal as bearing seal. Also, the compressor 5 and the expander 3 are incorporated in the same sealing case 85 and isolated by the pressure bulkhead 85*a*.

In such configuration, the refrigerant fed from the pump 1 to the refrigerant heater 2 is evaporated into gas refrigerant and then flows into the expander 3. Then the gas refrigerant expands in the expander 3 to generate work, and thus drives the compressor 5. The refrigerant flown out from the expander 3 is condensed in the outdoor heat exchanger 4*b* by exchanging heat with water, and then sucked into the pump 1 once again.

While, after heat-exchanged in the water cooled outdoor heat exchanger 4*b*, water is stored in the hot water storage tank 9*b*. A temperature of the water which is stored in the hot water storage tank 9*b* by using exhaust heat is determined by a condensing temperature. Therefore, as shown in FIG. 5A, in the case that the condensing temperature is less than 80° C., a heater 10*b* is provided in the hot water storage tank 9*b* to heat the water by using electric power during midnight.

Like the air conditioning equipment K22 shown in FIG. 5B, if a bypass pipe 11*b* is provided in parallel with the expander 3 in the first cycle, hot water with about 80° C. can be stored in the hot water storage tank 9*b* without the heater.

Third Embodiment

Figure 6:
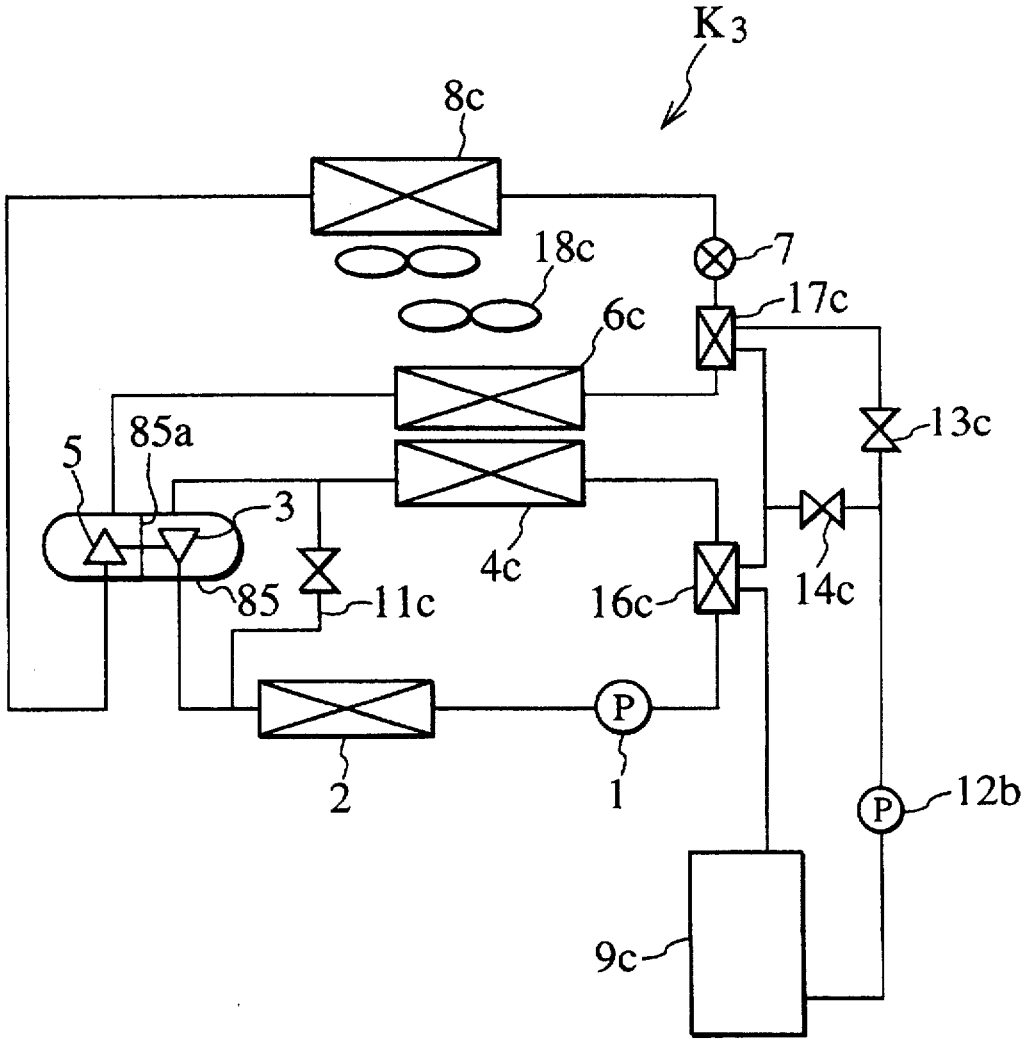
FIG. 6 is a block diagram showing an air conditioning equipment according to a third embodiment of the present invention.

FIG. 6 is a block diagram showing an air conditioning equipment K3 according to a third embodiment of the present invention.

In FIG. 6, the air conditioning equipment K3 consists of a first cycle (Rankine cycle) which is composed of the pump 1, the refrigerant heater 2, the expander 3, an air cooled outdoor heat exchanger 4*c*, and a water cooled outdoor heat exchanger 16*c*, etc., and a second cycle (refrigerating cycle) which is composed of the compressor 5, an air cooled outdoor heat exchanger 6*c*, a water cooled outdoor heat exchanger 17*c*, the expansion valve 7, an indoor heat exchanger 8*c*, etc.

Although the air cooled outdoor heat exchanger 4*c* and the air cooled outdoor heat exchanger 6*c* are integrally formed (a fan 18*c* is provided to them), their pipings are provided independently to prevent mixture of refrigerants in the first and second cycles. Mutual axes of the compressor 5 and the expander 3 are connected, and further mechanical seal is employed as bearing seal between the compressor 5 and the expander 3. Also, the compressor 5 and the expander 3 are incorporated in the same sealing case 85 via the pressure bulkhead 85*a*.

The water cooled outdoor heat exchanger 16*c* and the water cooled outdoor heat exchanger 17*c* are connected to a hot water storage tank 9*c* via a water pump 12*b* and selector valves 13*c*, 14*c*.

In such configuration, the refrigerant fed from the pump 1 to the refrigerant heater 2 is evaporated into gas refrigerant and then supplied to the expander 3. Then the gas refrigerant generates work while expanding in the expander 3, and thus drives the compressor 5. The refrigerant flown out from the expander 3 is condensed in the air cooled outdoor heat exchanger 4*c* and the water cooled outdoor heat exchanger 16*c*, and then sucked into the pump 1 once again.

In this event, the outdoor fan 18*c* for the air cooled outdoor heat exchangers 4*c*, 6*c* is ON/OFFed according to a temperature of water stored in the hot water storage tank 9*c*. In case a temperature of water is lower than a first set point (e.g., 45° C.), an operation of the outdoor fan 18*c* is halted and the refrigerant is condensed by the water cooled outdoor heat exchanger 16*c*. Thereby, the temperature of the water supplied to the hot water storage tank 9*c* is brought up.

On the contrary, in case the temperature of water is higher than the first set point (e.g., 45° C.), the outdoor fan 18*c* is operated while operating the pump 12*b* and only the selector valve 13*c* is opened. Further, in case the temperature of water becomes higher than the second set point (e.g., 65° C.), the pump 12*b* is halted and the outdoor fan 18*c* is operated. The refrigerant is condensed by the air cooled outdoor heat exchangers 4*c*, 6*c*.

Still further, if the temperature of the water of the hot water storage tank 9*c* is to be brought up still more, the water is directly heated by the refrigerant heater 2 via the bypass circuit 11*c*.

In the meanwhile, the gas refrigerant discharged from the compressor 5 is condensed by the air cooled outdoor heat exchanger 6*c* and the water cooled outdoor heat exchanger 17*c*, then converted into refrigerant with low temperature and low pressure by the expansion valve 7, then evaporated in the indoor heat exchanger 8*c*, and then sucked into the compressor 5. The water is caused to flow through the hot water storage tank 9*c*, the water cooled outdoor heat exchanger 17*c*, and the water cooled outdoor heat exchanger 16*c* in sequence, whereby exhaust heat is recovered in the cycle.

Fourth Embodiment

Figure 7:
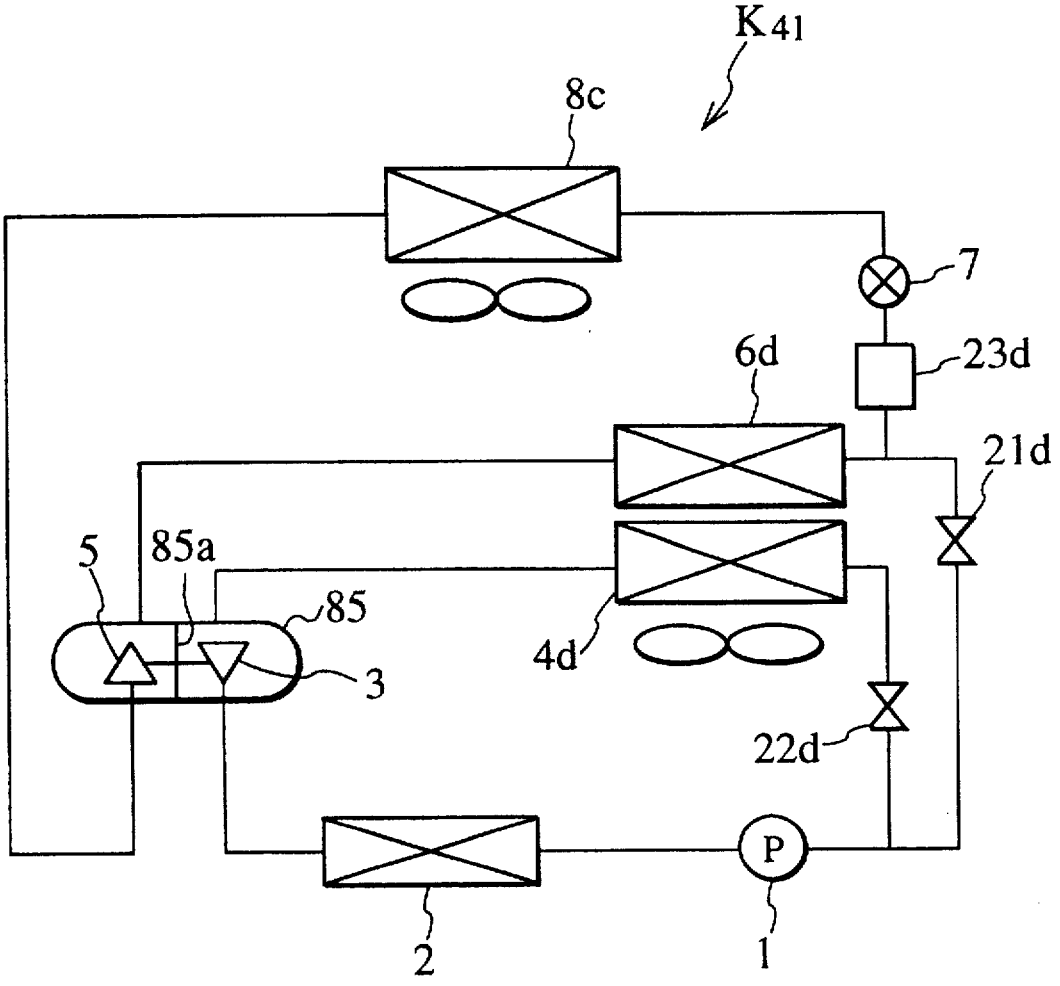
FIG. 7 is a block diagram showing an air conditioning equipment according to a fourth embodiment of the present invention.

FIG. 7 is a block diagram showing an air conditioning equipment according to a fourth embodiment of the present invention.

As shown in FIG. 7, the air conditioning equipment K41 consists of a first cycle (Rankine cycle) which is composed of the pump 1, the refrigerant heater 2, the expander 3, an outdoor heat exchanger 4*d*, a solenoid-controlled valve 22*d*, etc., and a second cycle (refrigerating cycle) which is composed of the compressor 5, an outdoor heat exchanger 6*d*, a receiver tank 23*d*, the expansion valve 7, an indoor heat exchanger 8*c*, etc.

The outdoor heat exchanger 4*d* and the outdoor heat exchanger 6*d* are integrally formed, but their pipings are provided independently not to mix refrigerants in the first and second cycles. In addition, the receiver tank 23*d* is connected to the pump 1 via a valve 21*d*. Mutual axes of the compressor 5 and the expander 3 are connected and in addition bearing seal between the compressor 5 and the expander 3 is made up of cheap mechanical seal. Also, the compressor 5 and the expander 3 are incorporated in the same sealing case 85 and the pressure bulkhead 85*a* is put between them.

With the above configuration, in the first cycle, the refrigerant fed from the pump 1 to the refrigerant heater 2 is evaporated into gas refrigerant and then flows into the expander 3. Thereafter, the gas refrigerant generates work while expanding in the expander 3, and thus drives the compressor 5. The refrigerant discharged from the expander 3 is condensed in the outdoor heat exchanger 4*d* and then sucked into the pump 1 again.

In the meanwhile, in the second cycle, the gas refrigerant discharged from the compressor 5 is condensed in the outdoor heat exchanger 6*d*, then converted into refrigerant with low temperature and low pressure by the expansion valve 7, then evaporated by the indoor heat exchanger 8*c*, and then sucked into the compressor 5 once again.

In this operation process, in the event that the refrigerant is transferred from the first cycle to the second cycle via the bearing seal between the compressor 5 and the expander 3, the refrigerant can be returned from the second cycle to the first cycle by operating the pump 1 after the valve 21*d* is opened and the valve 22*d* and the expansion valve 7 are closed when there is no cooling demand (first control example).

Figure 8:
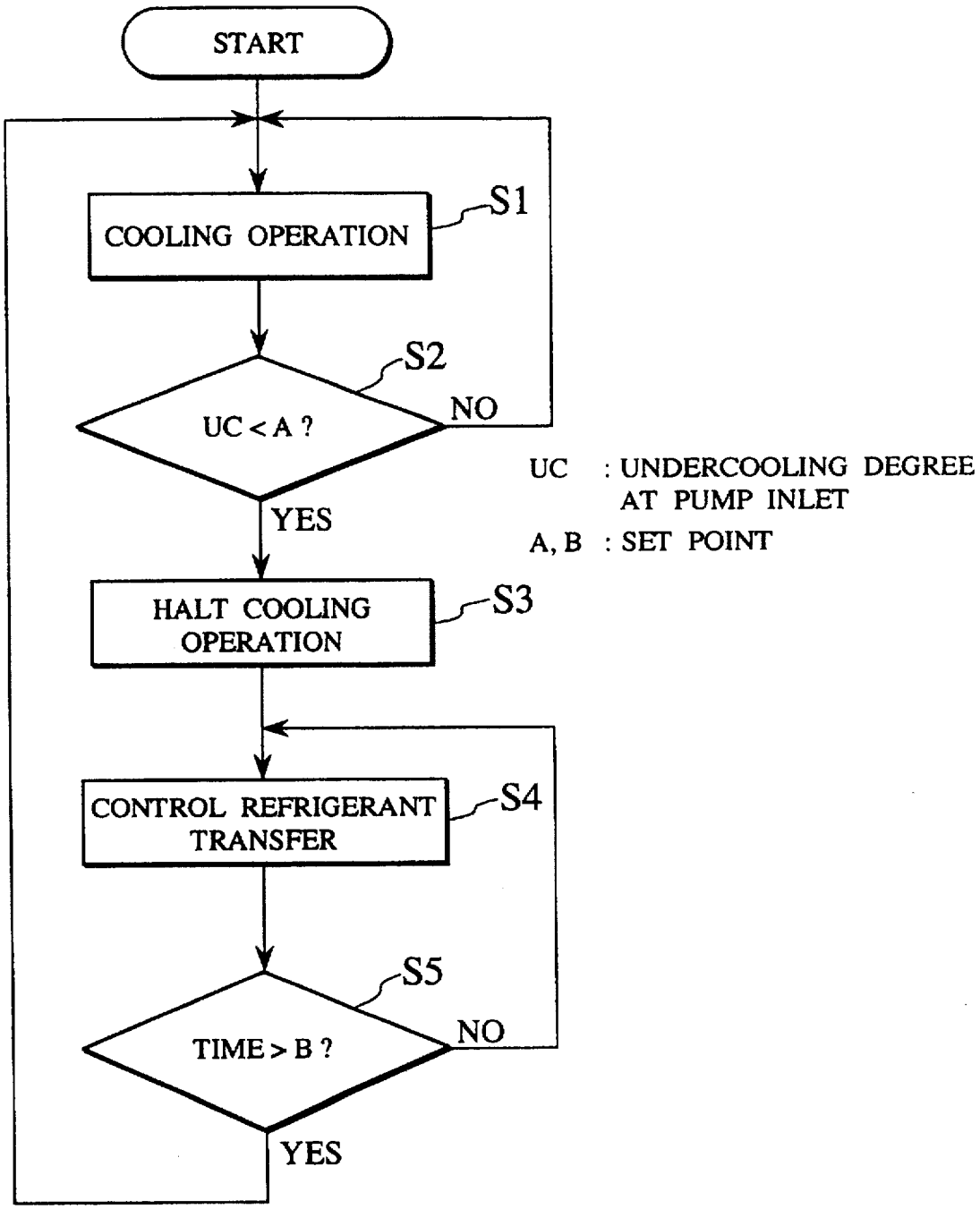
FIG. 8 is a flow chart showing a control example of the fourth embodiment of the present invention.

FIG. 8 is a flow chart showing a control example of the fourth embodiment of the present invention (flow chart of a second control example).

A transfer amount of working medium between the first cycle and the second cycle is detected in terms of undercooling degree at an inlet of the pump 1 in the first cycle.

During cooling operation (step S1), if undercooling degree UC is reduced less than a specified value A (step S2; YES), a cooling operation of the system is halted (step S3), then the transfer amount of the refrigerant is controlled (step S4), and the control is effected for a predetermined time B (step S5; YES), and then the cooling operation is carried out again (step S1).

Figure 9:
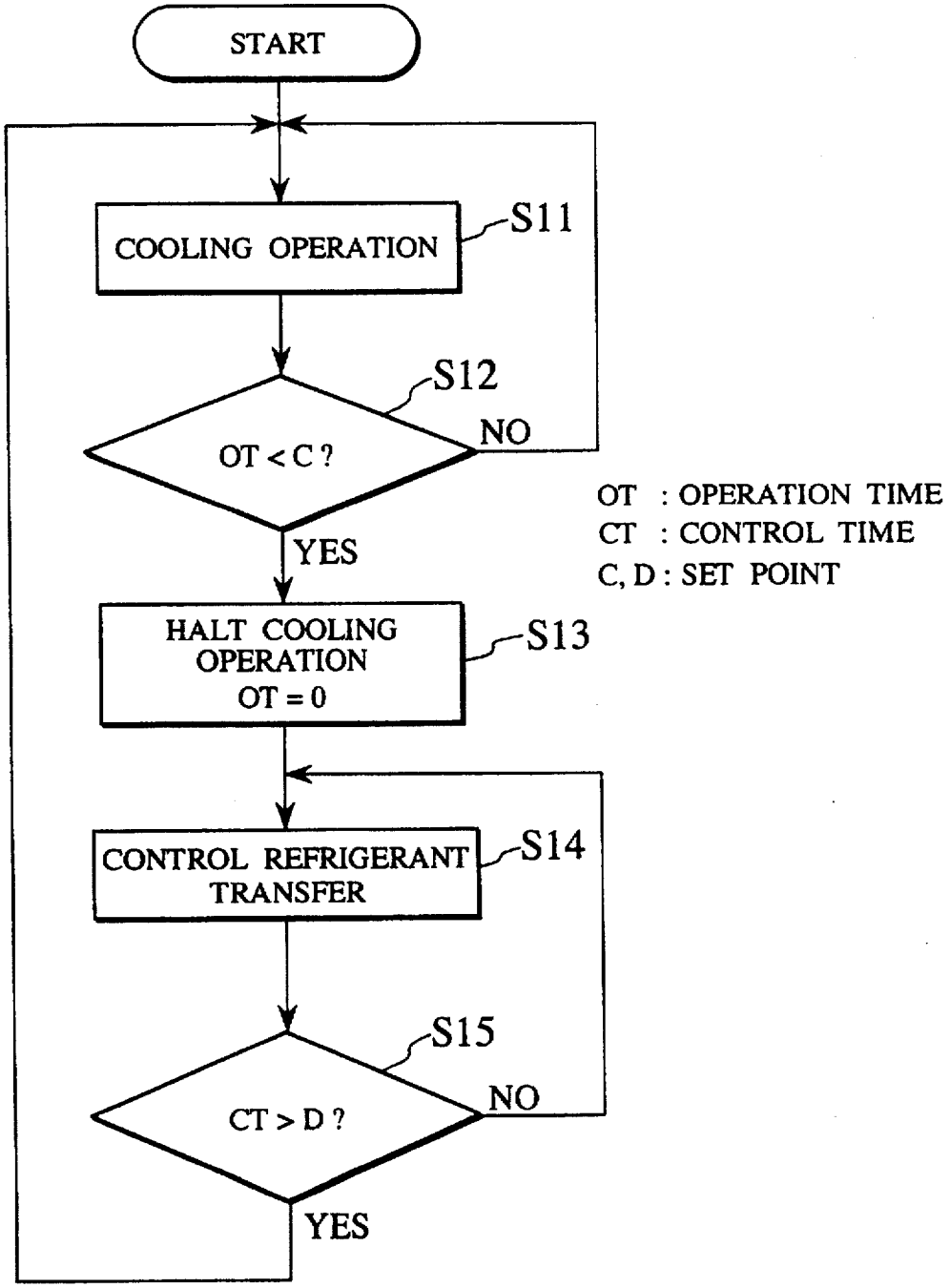
FIG. 9 is a flow chart showing another control example of the fourth embodiment of the present invention.

FIG. 9 is a flow chart showing another control example of the fourth embodiment of the present invention in case refrigerant is transferred at a predetermined operation time interval (flow chart of a third control example).

More particularly, during cooling operation (step S11), if a system operation time exceeds a specified value C (step S12; YES), a cooling operation of the system is halted (step S13), then means for transferring the refrigerant is operated (step S14). This control has been effected for a predetermined time D (step S15; YES), and the cooling operation is then carried out once again (step S11).

FIGS. 7 to 9 as described above illustrate the cases where the refrigerant is transferred by suspending temporarily the cooling operation.

Figure 10:
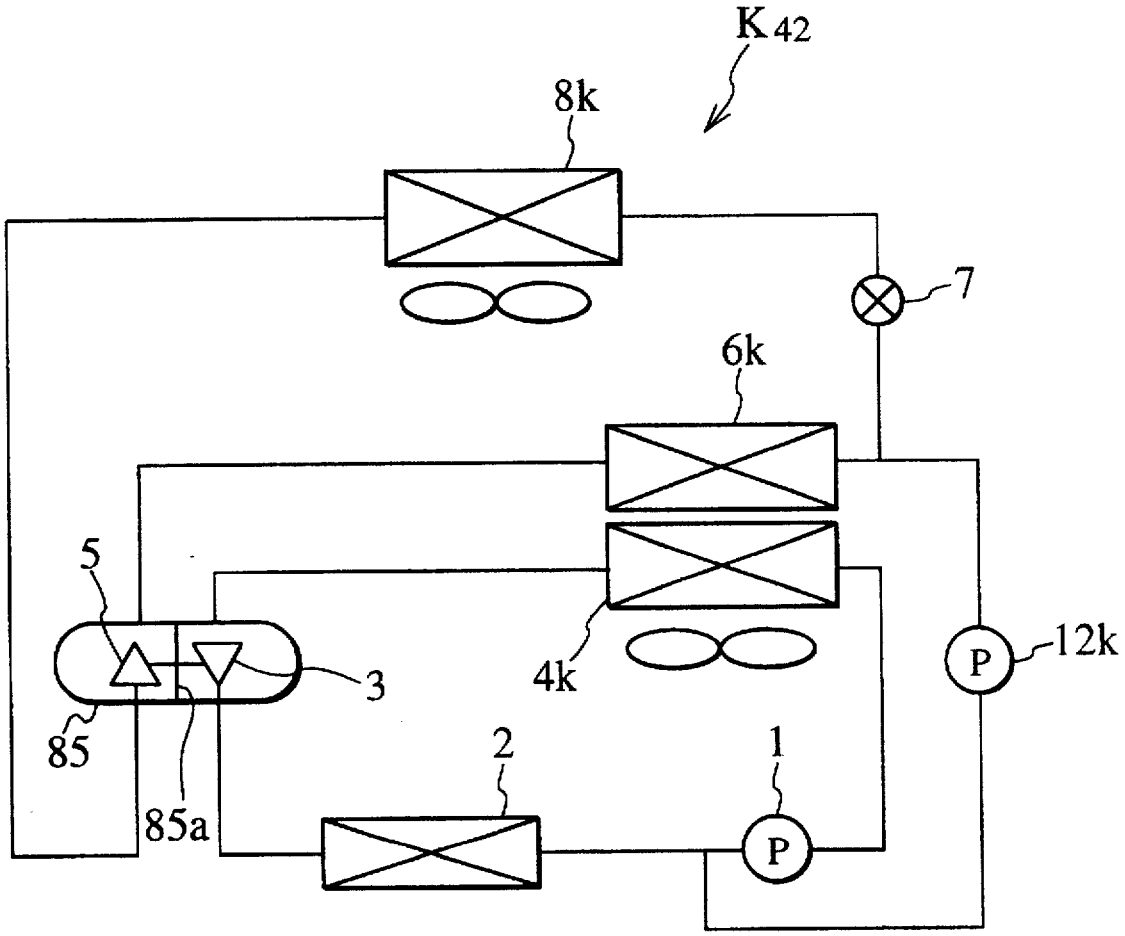
FIG. 10 is a block diagram showing an air conditioning equipment according to modification of a fourth embodiment of the present invention.

On the contrary, FIG. 10 is a block diagram showing an air conditioning equipment K42 according to modification of a fourth embodiment of the present invention wherein transfer of refrigerant can be controlled when the system is being operated.

In the air conditioning equipment K42, the first cycle (Rankine cycle) is composed of the pump 1, the refrigerant heater 2, the expander 3, an outdoor heat exchanger 4*k*, etc., and a second cycle (refrigerating cycle) is composed of the compressor 5, an outdoor heat exchanger 6*k*, the expansion valve 7, an indoor heat exchanger 8*k*, etc. The refrigerating cycle and an outlet side of the pump 1 of the Rankine cycle are connected by a bypass pipe via a pump 12*k*.

In the above configuration, if the pump 12*k* is operated during system operation, a part of condensing liquid of the refrigerating cycle can be returned to the Rankine cycle side. The pump 12*k* is started and stopped based on time, undercooling degree, etc.

Fifth Embodiment

Figure 11:
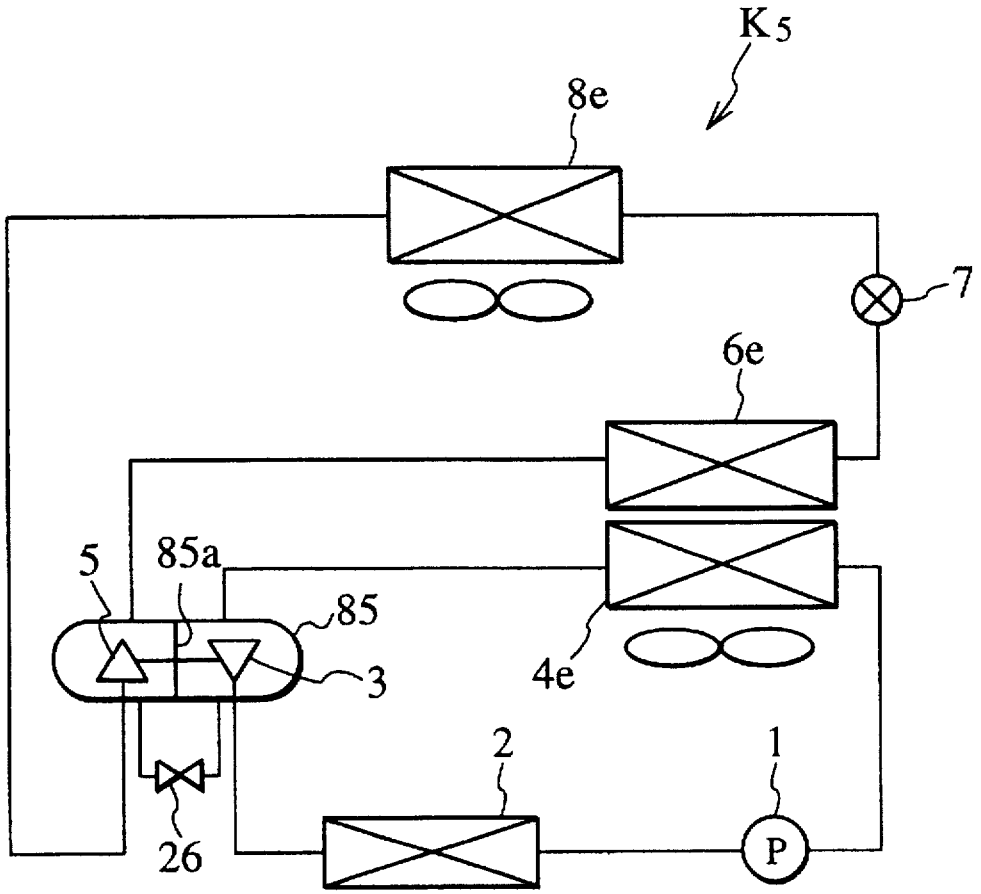
FIG. 11 is a block diagram showing an air conditioning equipment according to a fifth embodiment of the present invention.

FIG. 11 is a block diagram showing an air conditioning equipment according to a fifth embodiment of the present invention.

As shown in FIG. 11, the air conditioning equipment K5 consists of a first cycle (Rankine cycle) which is composed of the pump 1, the refrigerant heater 2, the expander 3, an outdoor heat exchanger 4*e*, etc., and a second cycle (refrigerating cycle) which is composed of the compressor 5, an outdoor heat exchanger 6*e*, the expansion valve 7, an indoor heat exchanger 8*e*, etc.

The outdoor heat exchanger 4*e* and the outdoor heat exchanger Be are integrally formed, but their pipings are provided independently to prevent mixture of refrigerants in the first and second cycles. In addition, mutual axes of the compressor 5 and the expander 3 are connected and also bearing seal between the compressor 5 and the expander 3 is made up of mechanical seal. Further, the compressor 5 and the expander 3 are connected via a valve 26. Also, the compressor 5 and the expander 3 are incorporated in the same sealing case 85 and isolated by the pressure bulkhead 85*a*.

In the above configuration, in the first cycle, the refrigerant fed from the pump 1 to the refrigerant heater 2 is evaporated into gas refrigerant and then flows into the expander 3. Thereafter, the gas refrigerant generates work while expanding in the expander 3 to thus drive the compressor 5. The refrigerant discharged from the expander 3 is condensed in the outdoor heat exchanger 4*e* and then sucked into the pump 1 again.

In the meanwhile, in the second cycle, the gas refrigerant discharged from the compressor 5 is condensed in the outdoor heat exchanger 6*e*, then converted into refrigerant with low temperature and low pressure by the expansion valve 7, then evaporated by the indoor heat exchanger 8*e*, and then sucked into the compressor 5 once again.

If the oil is transferred between both cycles via the bearing seal during operation, when there is no cooling demand, the oil is balanced between the compressor 5 and the expander 3 by opening the valve 26 for a predetermined time.

Sixth Embodiment

Figure 12A:
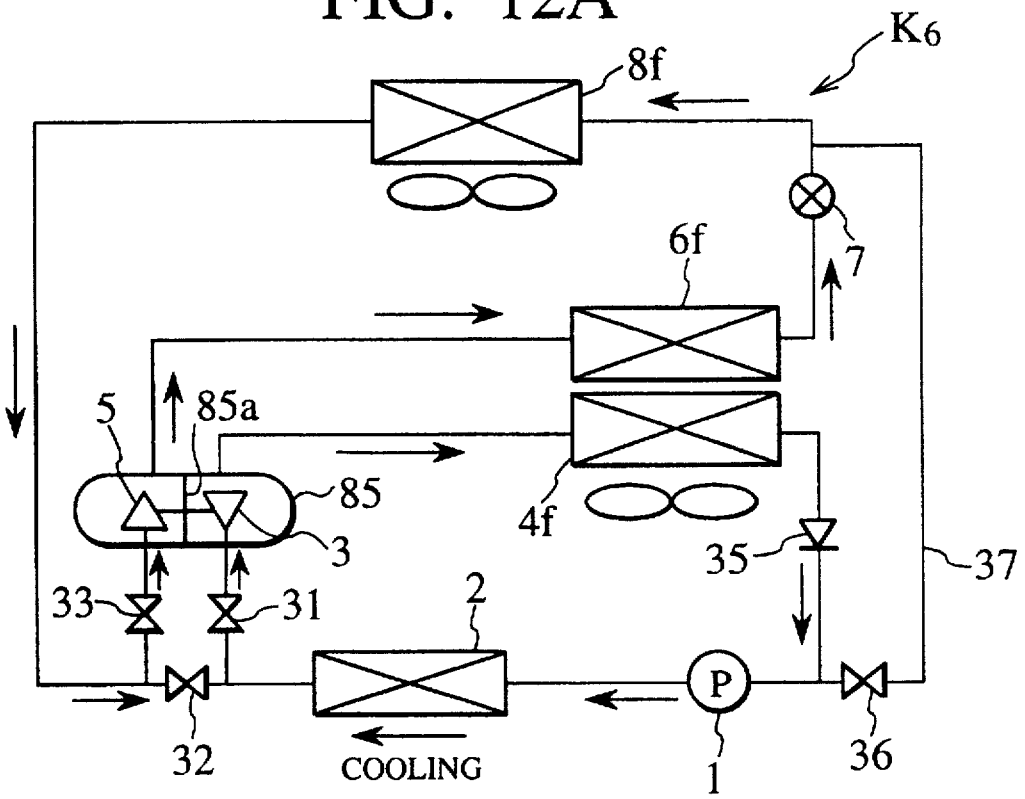
FIG. 12A is a block diagram showing an air conditioning equipment according to a sixth embodiment of the present invention in cooling operation mode.
Figure 12B:
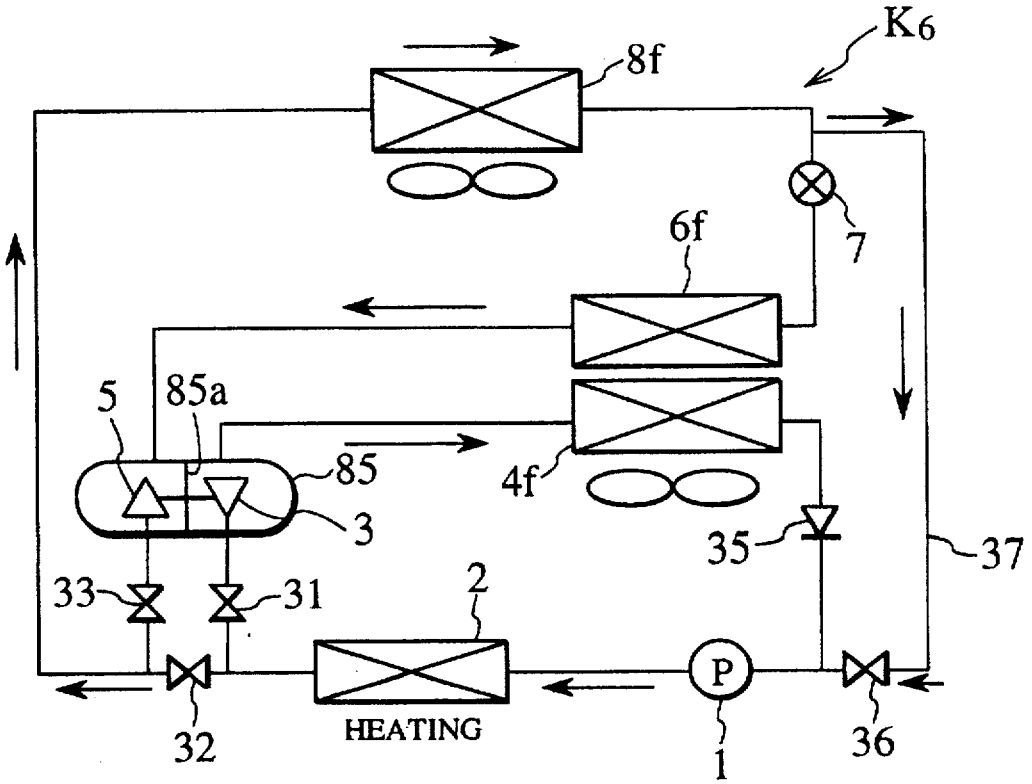
FIG. 12B is a block diagram showing an air conditioning equipment according to the sixth embodiment of the present invention in heating operation mode.

FIGS. 12A and 12B are block diagrams showing an air conditioning equipment according to a sixth embodiment of the present invention in cooling and heating operation modes respectively.

As shown in FIGS. 12A and 12B, the air conditioning equipment K6 consists of a first cycle which is composed of the pump 1, the refrigerant heater 2, the expander 3, an outdoor heat exchanger 4*f*, etc., and a second cycle which is composed of the compressor 5, an outdoor heat exchanger 6*f*, the expansion valve 7, an indoor heat exchanger 8*f*, etc.

The outdoor heat exchanger 4*f* and the outdoor heat exchanger 6*f* are integrally formed, but their pipings are provided independently not to mix refrigerants in the first and second cycles. In addition, mutual axes of the compressor 5 and the expander 3 are connected and further bearing seal between the compressor 5 and the expander 3 is made up of mechanical seal. Also, the compressor 5 and the expander 3 are incorporated in the same sealing case 85 via the pressure bulkhead 85*a*.

Still further, selector valves 31, 32, 33 for selecting flow paths are provided on the outlet side of the refrigerant heater 2. Both cycles are connected by a piping 37 having a switching valve which provided so as to bypass the expansion valve 7 and a check valve 35.

With the above configuration, the system will be operated in cooling mode as follows.

In other words, as shown in FIG. 12A, in the first cycle, the refrigerant fed from the pump 1 to the refrigerant heater 2 is evaporated into gas refrigerant and then flows into the expander 3 via the valve 31. After this, the gas refrigerant produces work while expanding in the expander 3 to thus drive the compressor 5. The refrigerant discharged from the expander 3 is condensed in the outdoor heat exchanger 4*f* and then sucked into the pump 1 again via the check valve 35.

Meanwhile, in the second cycle, the gas refrigerant discharged from the compressor 5 is condensed in the outdoor heat exchanger 6*f*, then converted into refrigerant with low temperature and low pressure by the expansion valve 7, then evaporated by the indoor heat exchanger 8*f*, and then sucked into the compressor 5 once again via the valve 33.

Next, an operation of the system in heating mode will be explained hereinbelow.

As shown is FIG. 12B, the refrigerant fed from the pump 1 to the refrigerant heater 2 is evaporated into gas, then passed through the selector valve 32, and then is condensed in the indoor heat exchanger 8*f*. The condensed refrigerant flows through the bypass piping 37 having the selector valve 36 and then returned to the pump 1.

Since the evaporating heat source in heating mode is combustion gas, reduction of heating capacity due to reduction of the outdoor air temperature is not caused.

Seventh Embodiment

Figure 13A:
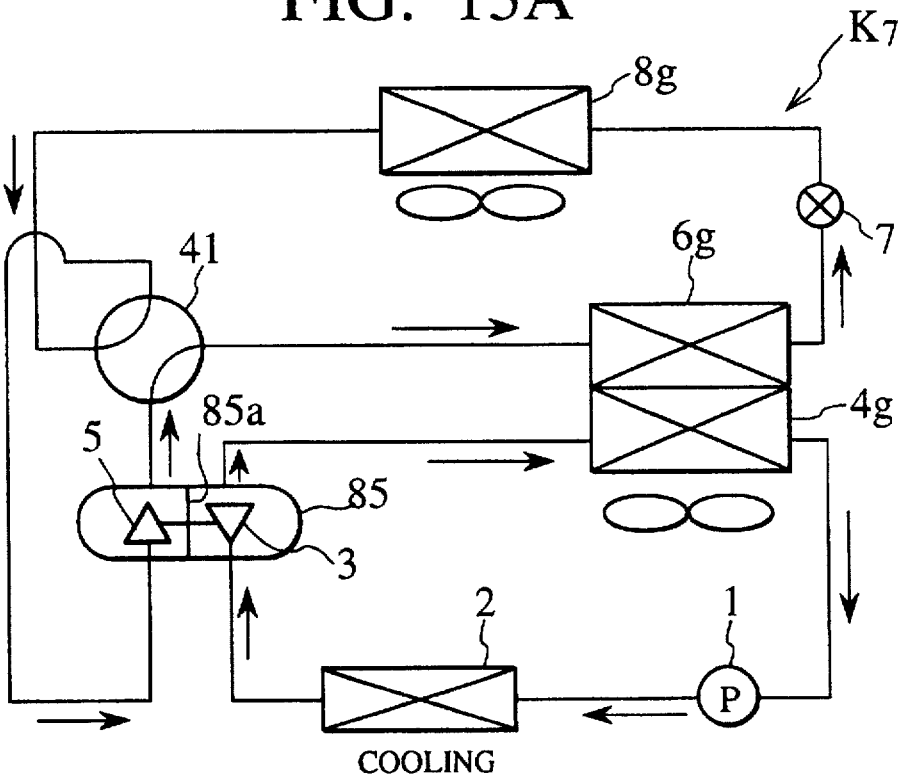
FIG. 13A is a block diagram showing an air conditioning equipment according to a seventh embodiment of the present invention in cooling operation mode.
Figure 13B:
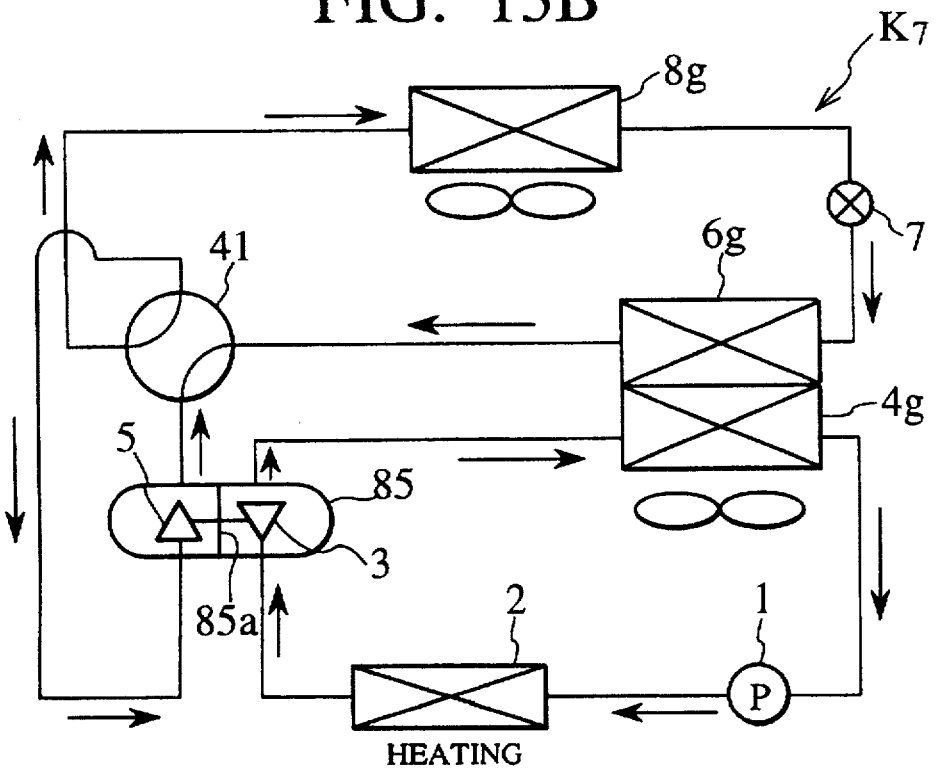
FIG. 13B is a block diagram showing an air conditioning equipment according to the seventh embodiment of the present invention in heating operation mode.

FIGS. 13A and 13B are block diagrams showing an air conditioning equipment according to a seventh embodiment of the present invention in cooling and heating operation modes respectively.

As shown in FIGS. 13A and 13B, the air conditioning equipment K7 consists of a first cycle which is composed of the pump 1, the refrigerant heater 2, the expander 3, an outdoor heat exchanger 4*g*, etc., and a second cycle which is composed of the compressor 5, an outdoor heat exchanger 6*g*, the expansion valve 7, an indoor heat exchanger 8*g*, a four-way valve 41, etc.

Although the outdoor heat exchanger 4*g* and the outdoor heat exchanger 6*g* are integrally constituted, their pipings are provided independently to prevent mixture of refrigerants in the first and second cycles. In addition, mutual axes of the compressor 5 and the expander 3 are connected and also bearing seal between the compressor 5 and the expander 3 is made up of mechanical seal. Here the compressor 5 and the expander 3 are incorporated in the same sealing case 85 and the pressure bulkhead 85*a* is put between them.

At first, an operation of the system in cooling mode will be explained hereinbelow.

As shown in FIG. 13A, in the first cycle, the refrigerant fed from the pump 1 to the refrigerant heater 2 is evaporated into gas refrigerant and then supplied to the expander 3. Then, the gas refrigerant produces work while expanding in the expander 3 to thus drive the compressor 5. The refrigerant discharged from the expander 3 is condensed in the outdoor heat exchanger 4*g* and then sucked into the pump 1 once again.

Meanwhile, in the second cycle, the gas refrigerant discharged from the compressor 5 is passed through the four-way valve 41, then condensed in the outdoor heat exchanger 6*g*, then converted into refrigerant with low temperature and low pressure by the expansion valve 7, then evaporated by the indoor heat exchanger 8*g*, and then sucked into the compressor 5 once again.

Next, an operation of the system in heating mode will be explained hereinbelow.

As shown is FIG. 13B, like in the cooling mode, the refrigerant is discharged from the compressor 5 which is driven by the expander 3 in the first cycle, then passed through the four-way valve 41 to the indoor heat exchanger 8*g*, and then condensed therein. After this, the refrigerant is passed through the expansion valve 7 and then evaporated in the outdoor heat exchanger 6*g*. Evaporated refrigerant is sucked into the compressor 5 again via the four-way valve 41.

In this case, because heating performance can be increased if the outdoor air temperature is relatively high, heating efficiency for a long term such as yearly mean heating efficiency can be improved.

Eighth Embodiment

Figure 14A:
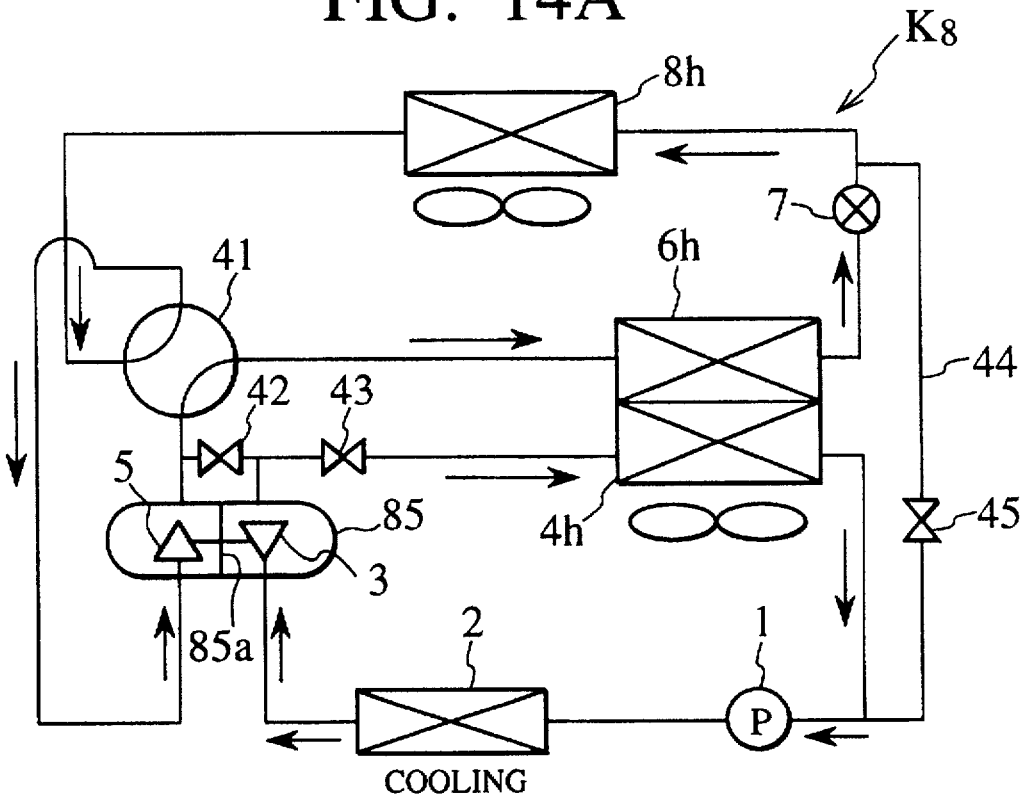
FIG. 14A is a block diagram showing an air conditioning equipment according to an eighth embodiment of the present invention in cooling operation mode.
Figure 14B:
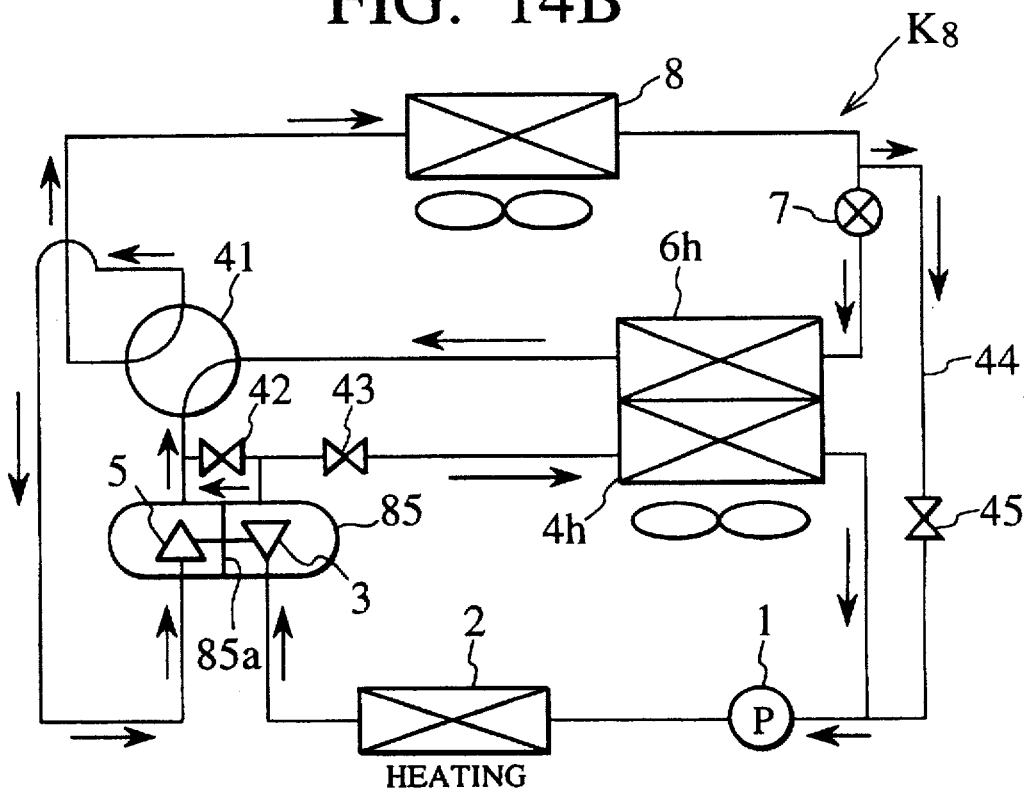
FIG. 14B is a block diagram showing an air conditioning equipment according to the eighth embodiment of the present invention in heating operation mode.

FIGS. 14A and 14B are block diagrams showing an air conditioning equipment according to an eighth embodiment of the present invention in cooling and heating operation modes.

As shown in FIGS. 14A and 14B, the air conditioning equipment K8 consists of a first cycle which is composed of the pump 1, the refrigerant heater 2, the expander 3, an outdoor heat exchanger 4*h*, etc., and a second cycle which is composed of the compressor 5, an outdoor heat exchanger 6*h*, the expansion valve 7, an indoor heat exchanger 8*h*, the four-way valve 41, etc.

An outlet of the expander 3 in the first cycle and an outlet of the compressor 5 in the second cycle are connected via a valve 42. The outdoor heat exchanger 4*h* and the outdoor heat exchanger 6*h* are integrally formed, but their pipings are provided independently to prevent mixture of refrigerants in the first and second cycles. In addition, mutual axes of the compressor 5 and the expander 3 are connected and further mechanical seal is used as bearing seal between the compressor 5 and the expander 3. In this case, the compressor 5 and the expander 3 are incorporated in the same sealing case 85 via the pressure bulkhead 85*a*.

An operation of the system in cooling mode will be explained hereinbelow.

As shown in FIG. 14A, in the first cycle, the refrigerant fed from the pump 1 to the refrigerant heater 2 is evaporated into gas refrigerant and then flows into the expander 3. Then, the gas refrigerant generates work while expanding in the expander 3 to thus drive the compressor 5. The refrigerant discharged from the expander 3 is passed through the valve 43, then condensed in the outdoor heat exchanger 4*h*, and then sucked into the pump 1 again.

Meanwhile, in the second cycle, the gas refrigerant discharged from the compressor 5 is passed through the four-way valve 41, and then condensed in the outdoor heat exchanger 6*h*. Thereafter, the gas refrigerant is converted into refrigerant with low temperature and low pressure by the expansion valve 7, then evaporated by the indoor heat exchanger 8*h*, and then sucked into the compressor 5 again via the four-way valve 41.

Subsequently, an operation of the system in heating mode will be explained hereinbelow.

As shown is FIG. 14B, the refrigerant fed from the pump 1 to the refrigerant heater 2 is evaporated into gas, then flows into the expander 3 so that the expander 3 is operated. The refrigerant discharged from the expander 3 is passed through the valve 42 and then converged with discharge gas of the compressor 5 which is driven by the expander 3. Converged refrigerant flows through the four-way valve 41, then condensed in the indoor heat exchanger 8*h*, and then split into the first cycle and the second cycle.

In other words, in the second cycle, the refrigerant flows into the outdoor heat exchanger 6*h* via the expansion valve 7 and then supplied to the four-way valve 41 and the compressor 5.

In contrast, in the first cycle, the refrigerant is sucked into the pump 1 via the bypass circuit 44 having the valve 45, and then fed to the refrigerant heater 2 once more.

In this manner, since exhaust heat on the Rankine cycle side is employed and heat is absorbed from the outdoor air in heating mode, high heating efficiency can be achieved irrespective of the outdoor air temperature.

Ninth Embodiment

FIGS. 15A to 15E are schematic views showing pipings of outdoor heat exchangers used respectively in a first cycle (Rankine cycle) and a second cycle (refrigerating cycle) according to a ninth embodiment of the present invention. FIGS. 16A and 16B are perspective views showing the cases where fin-plate coils (pipings) are used as the outdoor heat exchangers in first and second cycles in FIG. 15 respectively. Coils in the fin-plate coils (pipings) are made of copper which is a good thermal conductor and fins (pipes) are made of aluminum.

Figure 15A:
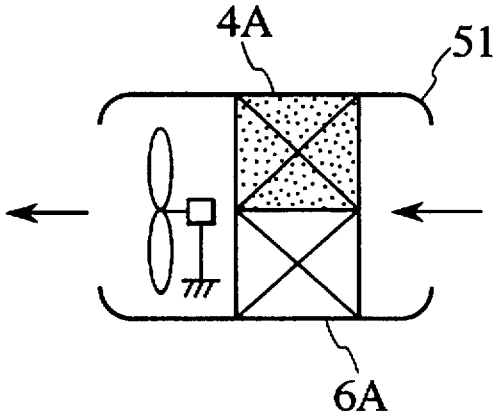
FIGS. 15A to 15E are schematic views showing pipings of outdoor heat exchangers in first and second cycles according to a ninth embodiment of the present invention respectively.
Figure 16A:
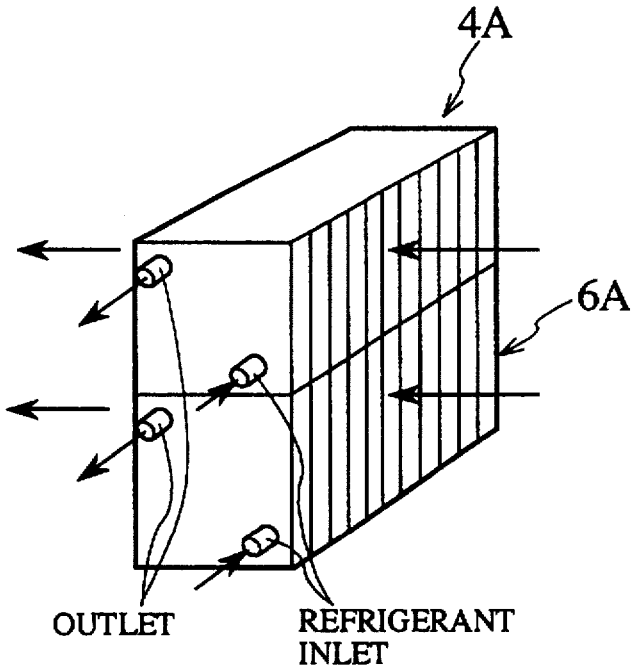
FIGS. 16A and 16B are perspective views showing representatives of the outdoor heat exchangers in first and second cycles in FIG. 15 respectively.
Figure 16B:
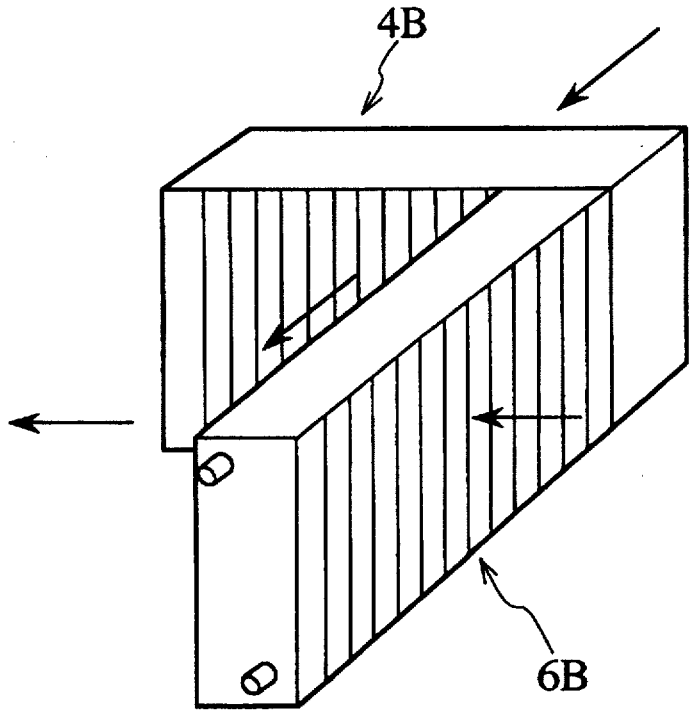

In FIGS. 15A and 16A, pipings (fin-plate coils) 4A of the outdoor heat exchanger in the first cycle are arranged on the upper side, and pipings 6A of the outdoor heat exchanger, etc. in the second cycle are arranged on the lower side. A reference 51 denotes an enclosure which is used to supply the air effectively.

Figure 15B:
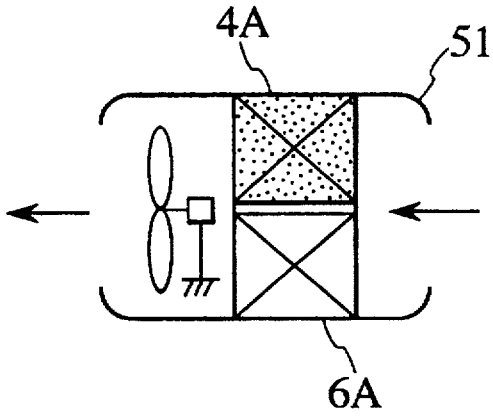

In FIG. 15B, pipings 4A, 6A are isolated vertically and a poor thermal conductor (e.g., plastic) is inserted into a clearance formed between the pipings 4A, 6A.

Figure 15C:
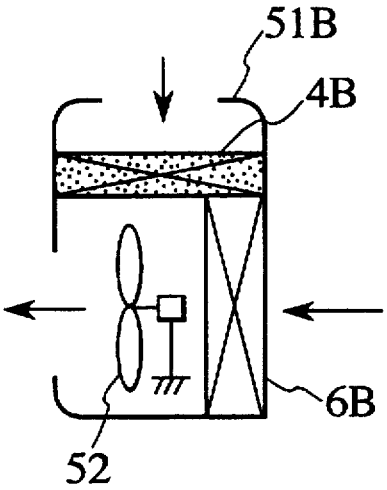

In FIGS. 15C and 16B, pipings 4B of the outdoor heat exchanger in the first cycle are arranged at a substantially right angle relative to the outdoor fan 52, and pipings 6B of the outdoor heat exchanger in the second cycle are arranged in parallel with the outdoor fan 52. A reference 51B denotes an enclosure which is used to supply the air effectively.

Figure 15D:
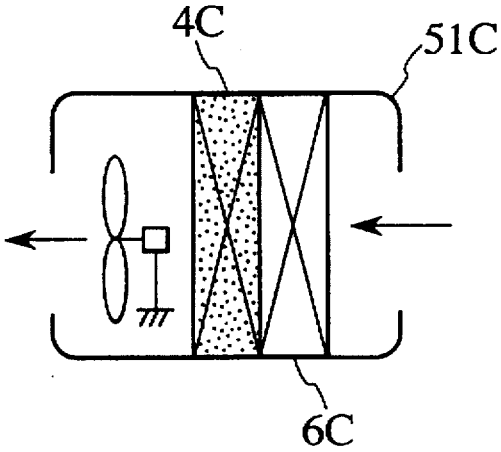

In FIG. 15D, pipings 4C of the outdoor heat exchanger in the first cycle are arranged on the downstream side of air flow, and pipings 6C of the outdoor heat exchanger in the second cycle are arranged on the upstream side of air flow. A reference 51C denotes an enclosure which is used to supply the air effectively.

Figure 15E:
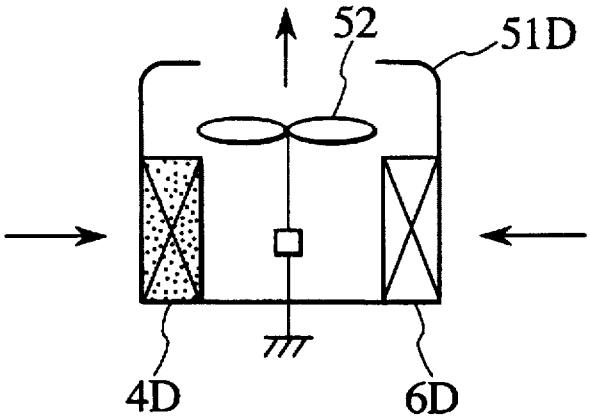

In FIG. 15E, pipings 4D, 6D of the outdoor heat exchangers in the first and second cycles are arranged on both sides of the outdoor fan 52 to be opposed to each other. Since pipings 4D, 6D of the outdoor heat exchangers are arranged to be poor in thermal conduction (heat is hard to transfer) in both cycles in this arrangement, thermal interference is not caused between both cycles. Therefore, respective condensing temperatures can be kept easily independently. A reference 51D denotes an enclosure which is used to supply the air effectively.

Tenth Embodiment

Figure 17A:
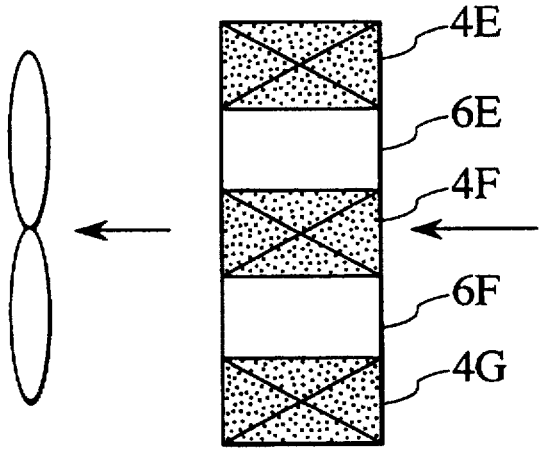
FIGS. 17A and 17B are schematic views showing pipings of outdoor heat exchangers in first and second cycles according to a tenth embodiment of the present invention respectively.
Figure 17B:
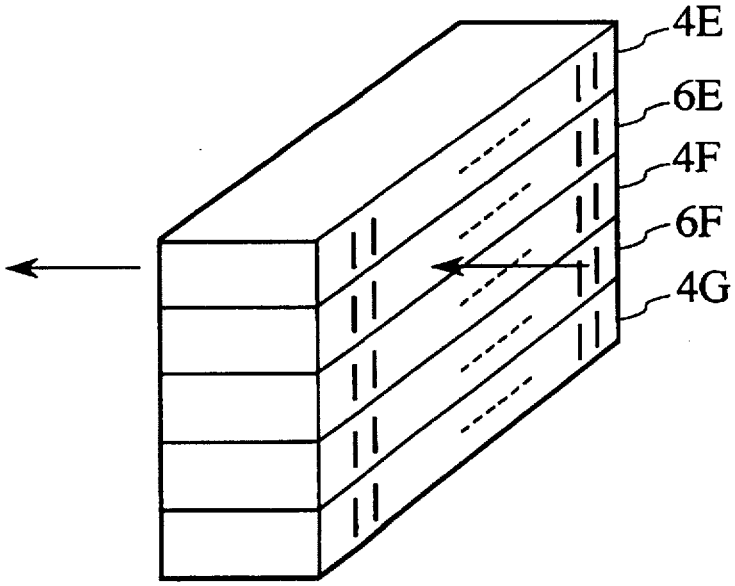

FIGS. 17A and 17B are schematic views showing pipings of outdoor heat exchangers in first and second cycles according to a tenth embodiment of the present invention respectively.

A configuration of the system is similar to those in FIGS. 13 and 14.

In FIGS. 17A and 17B, part of pipings 4E, 4F, 4G of the outdoor heat exchanger in the first cycle are arranged alternatively to pipings 6E, BF of the outdoor heat exchanger in the second cycle.

Since difference between refrigerant temperatures in the pipings of the outdoor heat exchanger in the first cycle and the pipings of the outdoor heat exchanger in the second cycle in heating mode is greater than that in cooling mode, heat transfer from the first cycle to the second cycle occurs in such alternatively arranged portions, so that a time can be prolonged until frost occurs in the second cycle.

In the first cycle, efficiency of Rankine cycle can be improved because of reduction in condensing temperature.

Eleventh Embodiment

Figure 18A:
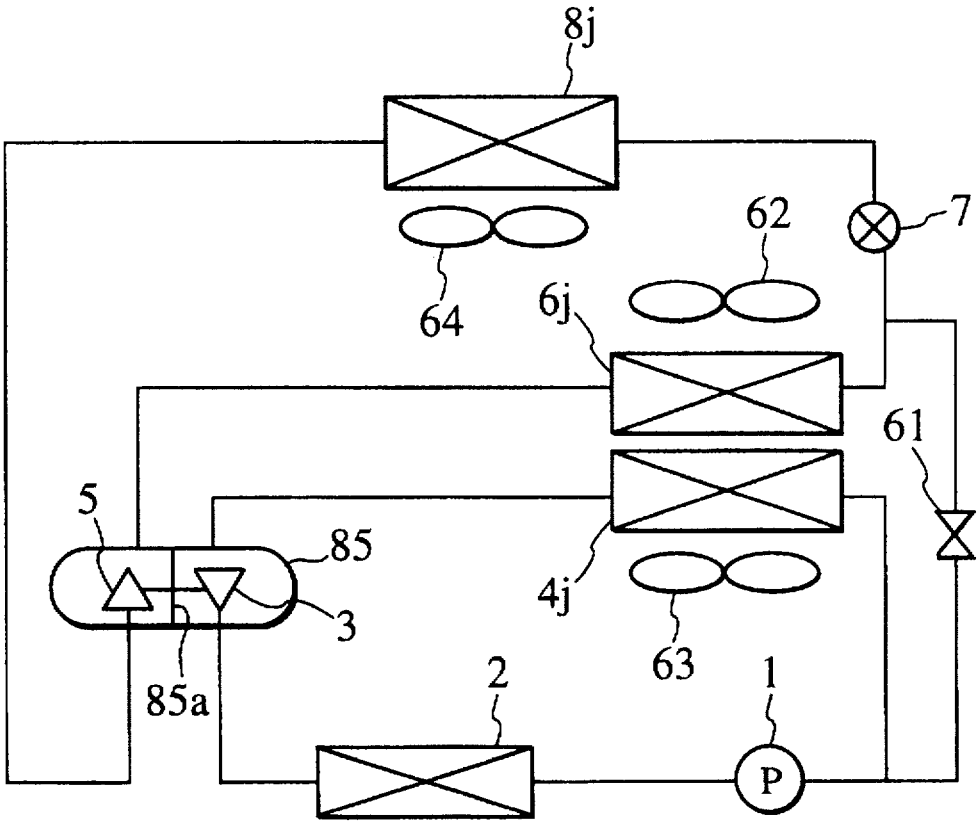
FIG. 18A is a block diagram showing an air conditioning equipment according to an eleventh embodiment of the present invention.
Figure 18B:
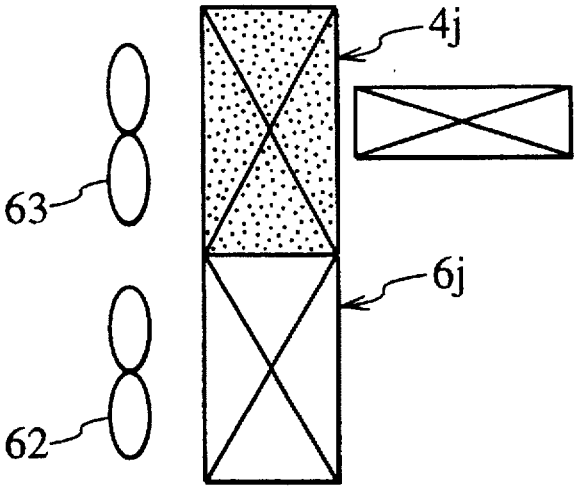
FIG. 18B is a schematic view showing pipings of outdoor heat exchangers in first and second cycles according to the eleventh embodiment of the present invention.

FIG. 18A is a block diagram showing an air conditioning equipment according to an eleventh embodiment of the present invention. FIG. 18B is a schematic view showing pipings of outdoor heat exchangers in first and second cycles according to the eleventh embodiment of the present invention.

Though the system configuration (block diagram) is substantially identical to that in FIG. 7, configurations of the outdoor heat exchangers 4*j*, 6*j* are different from that in FIG. 7. In other words, the outdoor heat exchangers 4*j*, 6*j* in both cycles are constituted to be poor in thermal conduction and dedicated outdoor fans 62, 63 are provided to the outdoor heat exchangers 4*j*, 6*j*.

Since an operation of the system in cooling mode is similar to the case in FIG. 7, only control of refrigerant transfer will be explained.

If an undercooling degree at an inlet of the pump 1 is lowered less than a set point, the number of revolution of the outdoor fan 62 on the second cycle side is slowed down. When the condensing temperature in the second cycle becomes higher than the condensing temperature in the first cycle, the expansion valve 7 is closed and the valve 61 is opened, so that refrigerant is transferred from the second cycle to the first cycle.

If undercooling degree at the inlet of the pump 1 is increase more than the set point, the expansion valve 7 is opened and the valve 61 is closed, and simultaneously the outdoor fan 62 is returned to the original number of revolution. Cooling operation is then continued.

Twelfth Embodiment

With the above configurations, because the expander in which rotating power is generated by high pressure gas is employed, such high pressure gas must be fed to the expander in starting operation. Therefore, it is likely that gas pressure becomes inevitably unstable in starting operation. In this twelfth embodiment, a technique will be explained hereinbelow which provides stable control of an inlet pressure of the expander in starting operation.

This twelfth embodiment will be explained in detail with reference to FIG. 19 hereunder.

Figure 19:
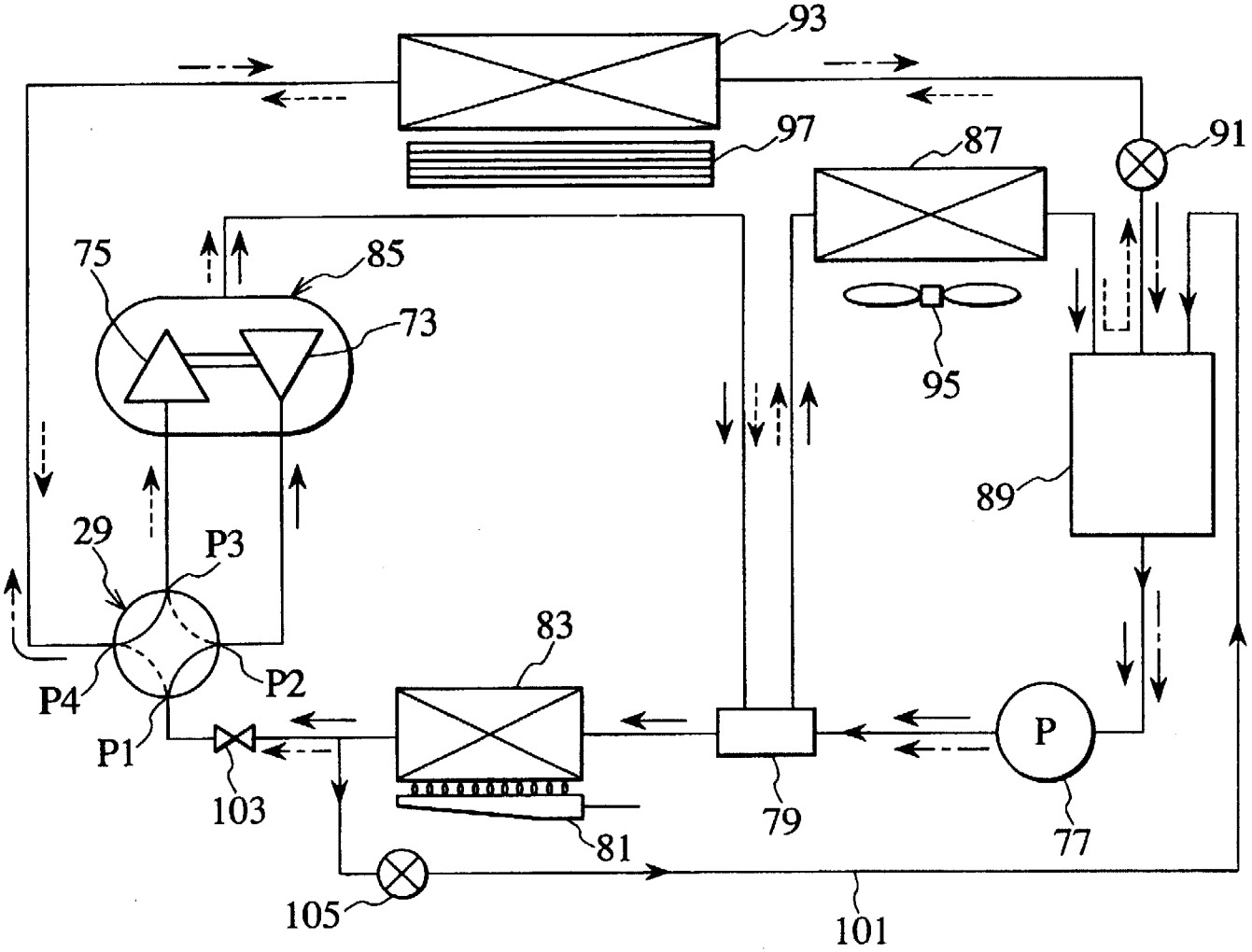
FIG. 19 is a block diagram showing a closed cycle in an overall air conditioning equipment according to the present invention.

FIG. 19 shows overall circuit of an air conditioning equipment of unitary type wherein the same refrigerant flows through an expander 73 and a compressor 75.

The circuit comprises a pump 77 for circulating forcedly refrigerant, a recuperator 79 arranged on the discharge side of the pump 77, a refrigerant heater 83 for providing heat to refrigerant by a burner 81 to generate a gas with high temperature and high pressure, the expander 73 for generating power by virtue of expansion task of high pressure gas, the compressor 75 to which rotating power is supplied by the expander 73, a fluid machinery 85 in which the expander 73 and the compressor 75 are incorporated in the same sealed case, an outdoor heat exchanger 87 serving as a condenser, a receiver 89 arranged on the suction side of the pump 77 to temporarily store liquid refrigerant, a throttle valve 91 for generating refrigerant with low temperature and low pressure by suddenly expanding the refrigerant, and an indoor heat exchanger 93 acting as an evaporator in cooling mode and a condenser in heating mode. Fans 95, 97 are provided to the outdoor heat exchanger 87 and the indoor heat exchanger 93 respectively. Furthermore, a four-way valve 99 serving as switching means for switching flow of refrigerant, and a closed cycle 101 serving as expansion starting means are provided corresponding to cooling operation mode and heating operation mode respectively.

The four-way valve 99 is arranged between the refrigerant heater 83 and the fluid machinery 85 and on the downstream side of the fluid machinery 85. The four-way valve 99 has four ports P1, P2, P3, P4.

The port P1 is connected to the refrigerant heater 83 via a switching valve 103. The port P2 is connected to an inlet side of the expander 73. The port P3 is connected to an inlet side of the compressor 75. The port P4 is connected to an outlet side of the indoor heat exchanger 93.

Consequently, if the ports P1 and P2 of the four-way valve 99 are coupled to each other and also the ports P3 and P4 of the four-way valve 99 are coupled to each other, a first cycle (indicated by solid line arrows in FIG. 19) and a second cycle (indicated by broken line arrows in FIG. 19) can be consisted respectively. In the first cycle, refrigerant discharged from the pump 77 is passed through the refrigerant heater 83, the expander 73, the recuperator 79, the outdoor heat exchanger 87, and the receiver 89 in sequence and then returned to the pump 77 again. In the second cycle, refrigerant which is branched from the receiver 89 and then fed to the throttle valve 91, the indoor heat exchanger 93 and the compresser 75, and then discharged from the compresser 75 is passed through the outdoor heat exchanger 87 and returned to the receiver 89 once again.

In addition, if the ports P1 and P4 of the four-way valve 99 are coupled to each other and also the ports P2 and P3 of the four-way valve 99 are coupled to each other, a third cycle (indicated by dot-dash line arrows in FIG. 19) can be consisted wherein refrigerant discharged from the pump 77 is passed through the refrigerant heater 83, then directly passed through the indoor heat exchanger 93, and then returned from the receiver 89 to the pump 77 once more.

In the closed cycle 101, circulation of refrigerant is repeated such that refrigerant is branched before the switching valve 103, then passed through the receiver 89 and the pump 77 via a throttle valve 105 for reducing pressure, and then returned to the refrigerant heater 83 again.

In the air conditioning equipment constituted as above, in cooling operation mode, by connecting the port P1 with the port P2 and connecting the port P3 with the port P4 of the four-way valve 99 and also starting the pump 77, refrigerant is heated when passed through the refrigerant heater 83 to be converted into high pressure gas, then passed through the switching valve 103, the four-way valve 99, and then fed to the expander 73. The high pressure gas executes expansion work in the expander 73 and the compresser 75 is driven by such power generated in the expander 73. An intermediate pressure gas output from the expander provides excess heat to the refrigerant discharged from the pump 77 in the recuperator 79, and then is passed through the indoor heat exchanger 87 to be turned into liquid refrigerant which is then fed to the receiver 89. The liquid refrigerant in the receiver 89 is returned to the pump 77 once more. To this end, the cooling cycle can be constituted.

Then, as indicated by broken line arrows in FIG. 19, liquid refrigerant divided from the receiver 89 is isoenthalpically changed by the throttle valve 91. Low pressure refrigerant is evaporated by exchanging its heat with the air supplied by the fan 27 when it is passed through the indoor heat exchanger 93. At this time, the air becomes cold air.

The refrigerant output from the indoor heat exchanger 93 is compressed by the compresser 75, and then converged with the intermediate pressure gas. A resultant gas provides its excess heat to the refrigerant discharged from the pump 77 when passed through the recuperator 79, and is then returned to the outdoor heat exchanger 87 and the receiver 89. To this end, the cycle can be constituted In contrast, in heating operation mode, by connecting the port P1 with the port P4 and connecting the port P2 with the port P3 of the four-way valve 99 and also starting the pump 77, refrigerant flows as indicated by dot-dash line arrows in FIG. 19 and is then converted into high pressure and high pressure gas when it is passed through the refrigerant heater 83, and then fed directly to the indoor heat exchanger 93. The high temperature and high pressure gas is condensed by exchanging its heat with the air supplied by the fan 27 when passed through the indoor heat exchanger 93. At this time, the air to which condensing heat is supplied in condensing becomes warm air.

The refrigerant output from the expander 73 is returned from the receiver 89 to the pump 77 via the throttle valve 91 again.

In turn, in starting the expander 73, by closing the switching valve 103 and driving the pump 77, high pressure gas being passed through the refrigerant heater 83 is returned to the pump 77 via the throttle valve 105 and the receiver 89. In this manner, a closed cycle is constituted.

In this event, since an inlet pressure of the expander, i.e., pressure of refrigerant at the switching valve 103 can be controlled stably, stable high pressure gas can be fed into an inlet side of the expander 73 if the switching valve is "opened" in starting the expander 73.

Figure 20:
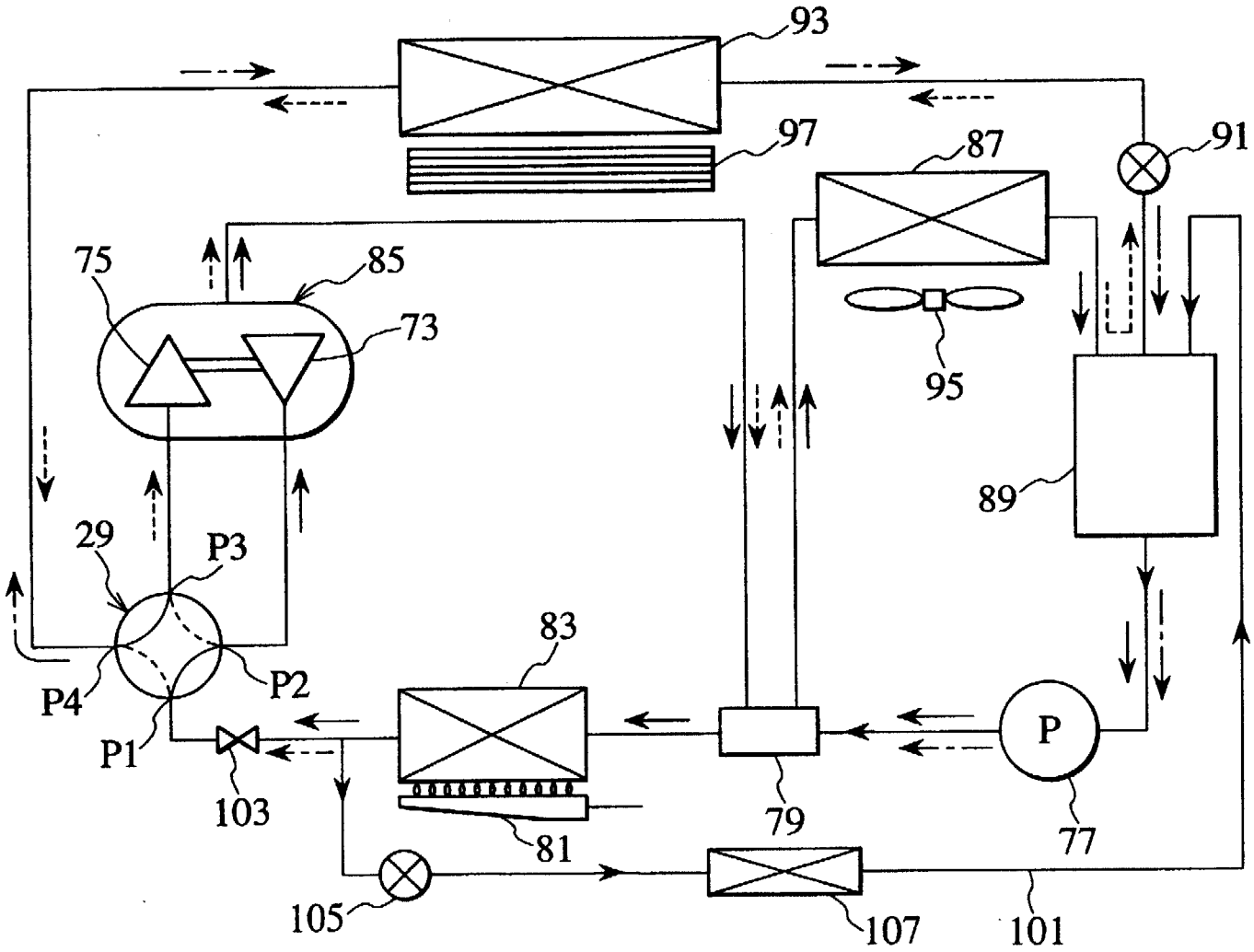
FIG. 20 is a block diagram showing another closed cycle in an overall air conditioning equipment according to the present invention.

Thereby, the expander 73 can be started smoothly and firmly. In this case, as shown in FIG. 20, a condenser 107 may be provided between the throttle valve 105 and the receiver 89 constituting the closed cycle 101.

Accordingly, since the refrigerant whose pressure is reduced by the throttle valve 105 is converted into liquid refrigerant with low temperature and low pressure when it is passed through the condenser 107 and the liquid refrigerant is then returned to the receiver to thereby constitute a closed cycle, it is possible to accomplish more stable control of the refrigerant. As a result, smooth and more stable start of the expander 73 can be assured, which leading to improvement of starting performance and reliability.

Figure 21:
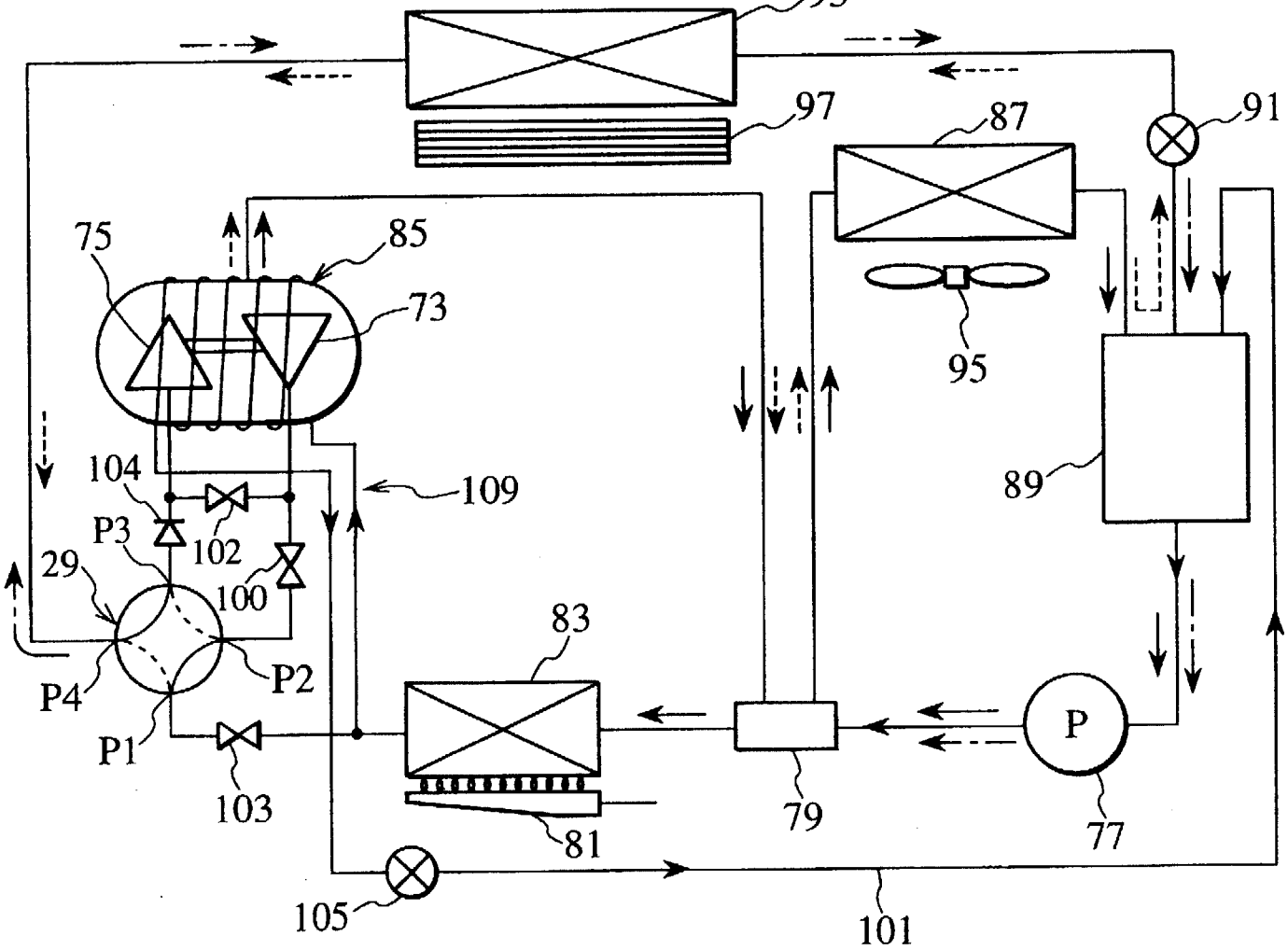
FIG. 21 is a block diagram showing still another closed cycle in an overall air conditioning equipment according to the present invention.

FIG. 21 is a block diagram showing still another closed cycle in an overall air conditioning equipment according to the present invention.

More particularly, a closed cycle 101 is provided wherein the refrigerant is circulated repeatedly via a heating circuit 109 which is branched from a circuit extending from the refrigerant heater 83 to the four-way valve 99 and surrounds the overall fluid machinery 85 composed of the expander 73 and the compresser 75; a throttle valve 105; the receiver 89; the pump 77; and the refrigerant heater 83. In addition, a first switching valve 100 for supplying refrigerant fed from the port P2 of the four-way valve 109 to an inlet side of the expander 73, a second switching valve 102 for supplying refrigerant passed through the first switching valve 100 to an inlet side of the compressor 75, and a check valve 104 for allowing refrigerant to flow in only the discharge direction from the port P3.

Since other constituent elements are the same as those in FIG. 19, their detailed description will be omitted by labeling them the same reference symbols.

According to this embodiment, for example, a stably-controlled high pressure gas can be fed to an inlet side of the expander 73 by opening the first switching valve 100, whereby smooth and sure starting can be achieved. In addition, if the switching valve 103 is closed in starting operation, the high temperature and high pressure gas which is discharged from the refrigerant heater 83 provides its heat to the expander 73 and the compresser 75 when it is passed through the heating circuit 109, and the standstill refrigerant in the expander 73 and the compresser 75 can be heated to thus enable gasification of refrigerant.

Therefore, since load can be reduced by preventing standstill of the refrigerant in the expander 73 and the compresser 75, the starting operation of the expander 73 can be facilitated.

If the expander 73 and the compresser 75 are directly heated by a heater (not shown) serving as a means for preventing standstill of the refrigerant, the similar advantage can be expected.

Figure 22:
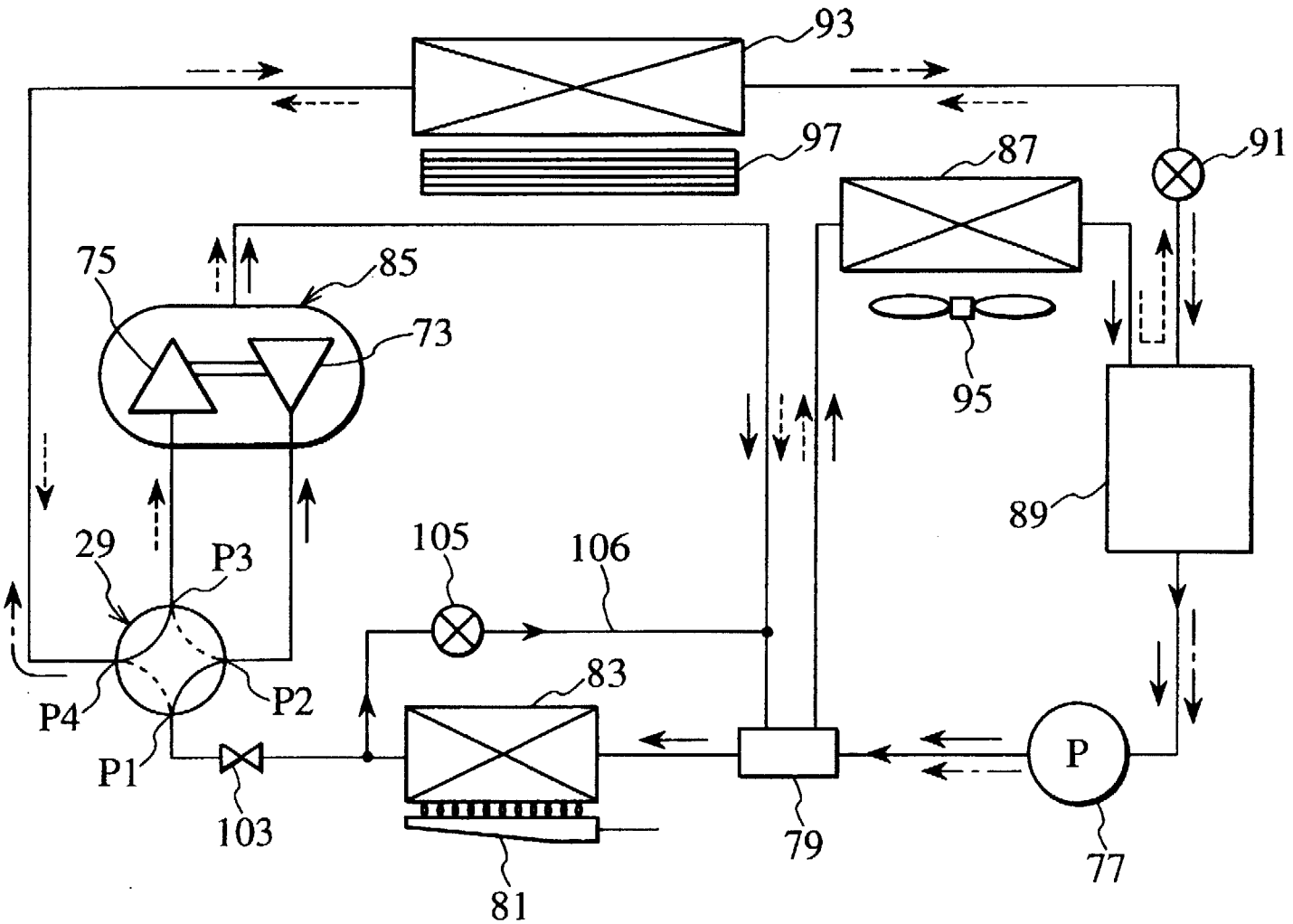
FIG. 22 is a block diagram showing yet still another closed cycle in an overall air conditioning equipment according to the present invention.

FIG. 22 shows yet still another closed cycle in an overall air conditioning equipment according to the present invention.

More particularly, a closed cycle is constituted in which the refrigerant is circulated repeatedly via the refrigerant heater 83, the throttle valve 105, the recuperator 79, the outdoor heat exchanger 87, the receiver 89, the pump 77, the recuperator 79, and the refrigerant heater 83.

Since other constituent elements are the same as those in FIG. 19, their detailed description will be omitted by labeling them the same reference symbols.

According to this embodiment, in addition to the advantage in FIG. 19, since a closed cycle which is composed of the recuperator 79, the outdoor heat exchanger 87, the receiver 89, and the pump 77 can be constituted only by supplementing a circuit 106 passing through the throttle valve 105, main side circuits can be utilized. Hence, such an advantage can be achieved that assembling operation and the circuit configuration can be simplified.

Figure 23:
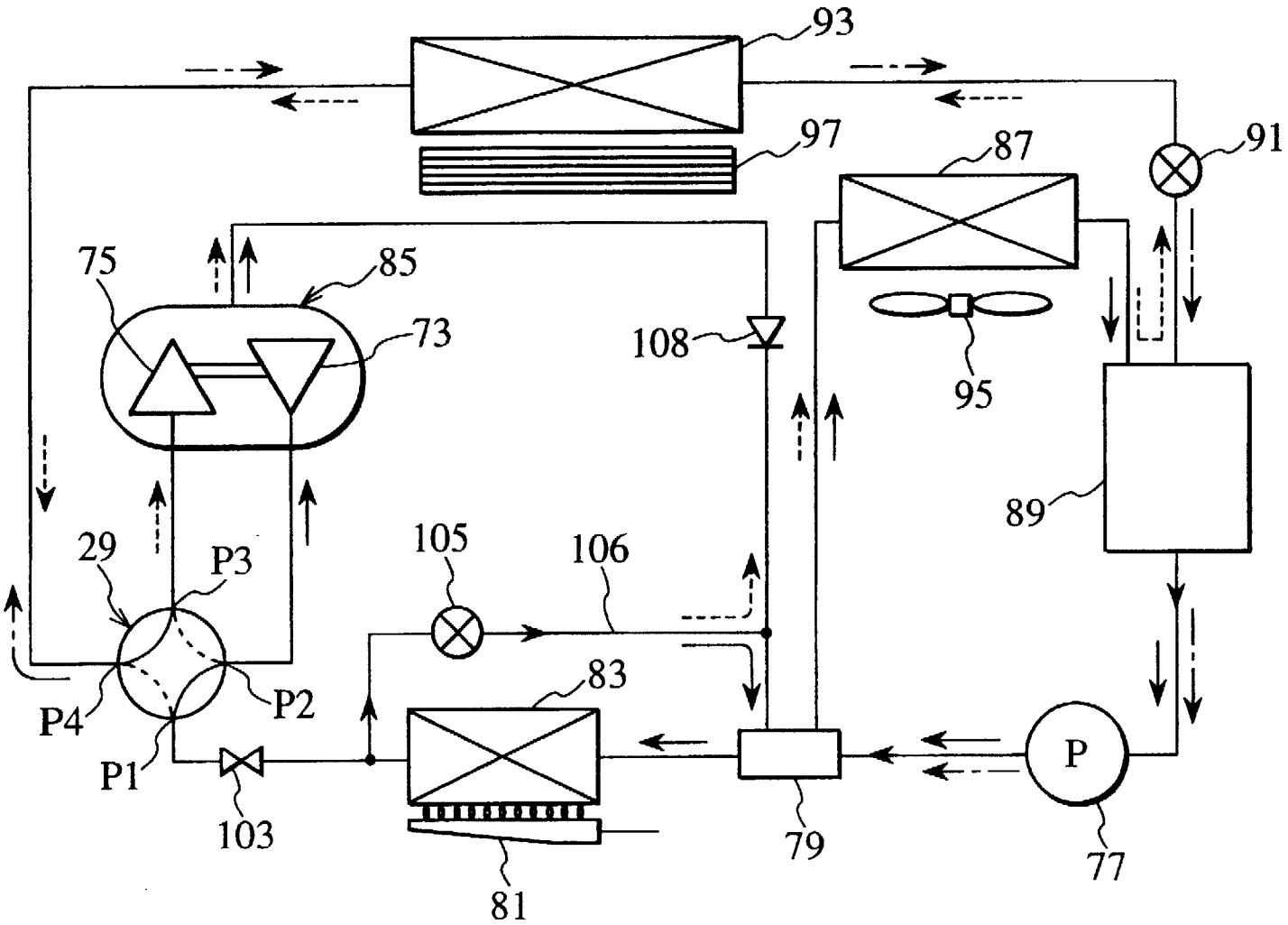
FIG. 23 is a block diagram showing a further closed cycle in an overall air conditioning equipment according to the present invention.

In this case, as shown in FIG. 23, if a check valve 108 is provided on the outlet side of the fluid machinery 85 to allow one-way flow, the refrigerant can be prevented from flowing from the throttle valve 105 to the outlet side of the fluid machinery 85.

Accordingly, such an advantage can be achieved that flow of the standstill refrigerant can be prevented.

What is claimed is:

1. An air conditioning equipment comprising:

a refrigerant heater for heating a refrigerant;

an expander for expanding said refrigerant output from said refrigerant heater to generate a driving force;

an outdoor heat exchanger for cooling said refrigerant output from said expander;

a pump for feeding said refrigerant output from said outdoor heat exchanger to said refrigerant heater, whereby said refrigerant heater, said expander, said outdoor heat exchanger, and said pump constitute a first cycle;

a compressor operated by said driving force derived from said expander in cooling operation mode, for compressing a refrigerant;

an outdoor heat exchanger for cooling said refrigerant discharged from said compressor;

an expansion valve for expanding said refrigerant output from said outdoor heat exchanger; and an indoor heat exchanger for receiving said refrigerant whose temperature is lowered by said expansion valve, whereby said compressor, said outdoor heat exchanger, said expansion valve, and said indoor heat exchanger constitute a second cycle;

wherein said refrigerant circulated in said first cycle and said refrigerant circulated in said second cycle are identical in composition, and said compressor and said expander are incorporated into a same sealing case.

2. An air conditioning equipment as claimed in claim 1, wherein a condensing pressure of said first cycle and a condensing pressure of said second cycle in cooling mode are set to different values in Mollier chart.

3. An air conditioning equipment as claimed in claim 2, wherein a radiating source in a condensing operation in said second cycle and a radiating source in a condensing operation of said first cycle are made as different radiating sources.

4. An air conditioning equipment as claimed in claim 1, further comprising means for enabling working medium to transfer between said first cycle and said second cycle.

5. An air conditioning equipment as claimed in claim 1, further comprising means for enabling oil to transfer between said first cycle and said second cycle.

6. An air conditioning equipment as claimed in claim 1, wherein a refrigerant gas fed from said refrigerant heater constituting said first cycle is introduced into said indoor heat exchanger constituting said second cycle in heating mode.

7. An air conditioning equipment as claimed in claim 1, wherein a refrigerant gas fed from said compressor constituting said second cycle is introduced into said indoor heat exchanger constituting said second cycle in heating mode.

8. An air conditioning equipment as claimed in claim 1, wherein a mixed gas of a gas discharged from said compressor constituting said second cycle and a gas discharged from said expander constituting said first cycle is introduced into said indoor heat exchanger constituting said second cycle in heating mode.

9. An air conditioning equipment as claimed in claim 1, wherein said outdoor heat exchanger for cooling said refrigerant fed from said expander and said outdoor heat exchanger for cooling said refrigerant discharged from said compressor are installed in a same enclosure such that poor heat transfer is assured between them.

10. An air conditioning equipment as claimed in claim 1, wherein said outdoor heat exchanger for cooling said refrigerant fed from said expander and said outdoor heat exchanger for cooling said refrigerant discharged from said compressor are installed in a same enclosure such that good heat transfer is assured between at least part of them.

11. An air conditioning equipment as claimed in claim 1, wherein said outdoor heat exchanger for cooling said refrigerant fed from said expander and said outdoor heat exchanger for cooling said refrigerant discharged from said compressor are equipped with independent outdoor fans respectively.

12. An air conditioning equipment as claimed in claim 1, wherein said outdoor heat exchanger for cooling said refrigerant fed from said expander also serves as said outdoor heat exchanger for cooling said refrigerant discharged from said compressor.

13. An air conditioning equipment as claimed in claim 12, wherein said refrigerant fed from said outdoor heat exchanger is introduced into said pump via a receiver.

14. An air conditioning equipment as claimed in claim 13, further comprising a flow path for connecting said refrigerant heater to said receiver, and a switching valve for isolating selectively said refrigerant heater from said expander, and wherein, when said switching valve is closed, said refrigerant fed from said refrigerant heater is circulated through a closed cycle consisting of said refrigerant heater, said receiver, said pump, and said flow path.

15. An air conditioning equipment as claimed in claim 14, further comprising, in heating mode, a third cycle in which said first refrigerant discharged from said pump is fed directly to said indoor heat exchanger via said refrigerant heater and then returned from said receiver to said pump once again.

16. An air conditioning equipment as claimed in claim 14, wherein said closed cycle is constituted such that a circulation of said refrigerant is branched off from a circuit extending from said refrigerant heater to an inlet side of said expander, then passed through a throttle valve, said receiver and said pump, and then returned to said refrigerant heater again.

17. An air conditioning equipment as claimed in claim 14, wherein a condenser is provided between said throttle valve and said receiver constituting said closed cycle.

18. An air conditioning equipment as claimed in claim 14, wherein, when said refrigerant is circulated in said closed cycle, a circulation of said refrigerant is branched off from a circuit extending from said refrigerant heater to an inlet side of said expander, and then passed through a heating circuit for heating said expander and said compressor, a throttle valve, said receiver and said pump, and then returned to said refrigerant heater again.

19. An air conditioning equipment as claimed in claim 14, wherein an operation of said pump constituting said closed cycle is continued even when an operation of said expander is halted.

20. An air conditioning equipment as claimed in claim 14, wherein, when said refrigerant is circulated in said closed cycle, a circulation of said refrigerant is branched off from a circuit extending from said refrigerant heater to an inlet side of said expander, and then passed through a throttle valve, said outdoor heat exchanger, said receiver and said pump, and then returned to said refrigerant heater again.

21. An air conditioning equipment as claimed in claim 14, wherein a check valve for preventing a flow of a working gas from a throttle valve to an outlet side of said expander is provided in a circuit including said throttle valve constituting said closed cycle.

* * * * *